US010361490B1

(12) United States Patent
Lee et al.

(10) Patent No.: US 10,361,490 B1
(45) Date of Patent: Jul. 23, 2019

(54) PATTERN DIVERSITY ASSISTED ANTENNA SYSTEMS

(71) Applicant: AMAZON TECHNOLOGIES, INC., Seattle, WA (US)

(72) Inventors: Tzung-I Lee, San Jose, CA (US); In Chul Hyun, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 584 days.

(21) Appl. No.: 14/968,682

(22) Filed: Dec. 14, 2015

(51) Int. Cl.

| | |
|---|---|
| ***H01Q 21/29*** | (2006.01) |
| ***H01Q 1/50*** | (2006.01) |
| ***H01Q 5/42*** | (2015.01) |
| ***H01Q 5/30*** | (2015.01) |
| ***H01Q 1/24*** | (2006.01) |

(52) U.S. Cl.
CPC ..... *H01Q 21/29* (2013.01); *H01Q 1/243* (2013.01); *H01Q 1/50* (2013.01); *H01Q 5/30* (2015.01); *H01Q 5/42* (2015.01)

(58) Field of Classification Search
CPC combination set(s) only.
See application file for complete search history.

(56) References Cited

U.S. PATENT DOCUMENTS 8,754,817 B1 * 6/2014 Kuo ..... H01Q 1/243 343/700 MS
8,847,828 B1 * 9/2014 Lee ..... H01Q 5/30 343/700 MS
2005/0064897 A1 3/2005 Nohara et al.
2009/0167627 A1 7/2009 Breiter
2010/0248669 A1 9/2010 Jerng
2011/0148731 A1 * 6/2011 Asrani ..... H01Q 1/243 343/841
2015/0147980 A1 5/2015 Larsen et al.
2015/0340761 A1 * 11/2015 Feng ..... H01Q 9/42 343/724

OTHER PUBLICATIONS

Zhang, S., Zhao, K., Zhu, B., Ying, Z. and He, S., 2014. MIMO reference antennas with controllable correlations and total efficiencies. Progress in Electromagnetics Research, 145, pp. 115-121.*
Non-Final Office Action dated Sep. 8, 2016, on U.S. Appl. No. 14/632,929.

* cited by examiner

*Primary Examiner* — Zhitong Chen
(74) *Attorney, Agent, or Firm* — Lowenstein Sandler LLP

(57) ABSTRACT

Antenna structures and methods of operating the same of an electronic device are described. One apparatus includes a radio coupled to a RF feed and an RF switch, a first antenna element coupled to the RF feed, and a second antenna element coupled to the RF switch, the RF switch being coupled to a grounding point of a ground plane. The radio controls the RF switch between a first mode and a second mode. The radio causes the first antenna element to radiate electromagnetic energy in a first radiation pattern in the first mode and causes the second antenna element to radiate electromagnetic energy in a second radiation pattern in the second mode. The second radiation pattern is different than the first radiation pattern.

16 Claims, 18 Drawing Sheets

Blue: Monopole mode 550
Green: Loop mode 500

Blue: Monopole mode 800
Green: Coupled mode 850

Blue: Monopole mode 1400
Green: Parasitic mode 1450

PATTERN DIVERSITY ASSISTED ANTENNA SYSTEMS

RELATED APPLICATIONS

This application is related to U.S. patent application Ser. No. 14/632,929, filed Feb. 26, 2015.

BACKGROUND

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas.

BRIEF DESCRIPTION OF DRAWINGS

The present inventions will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1:
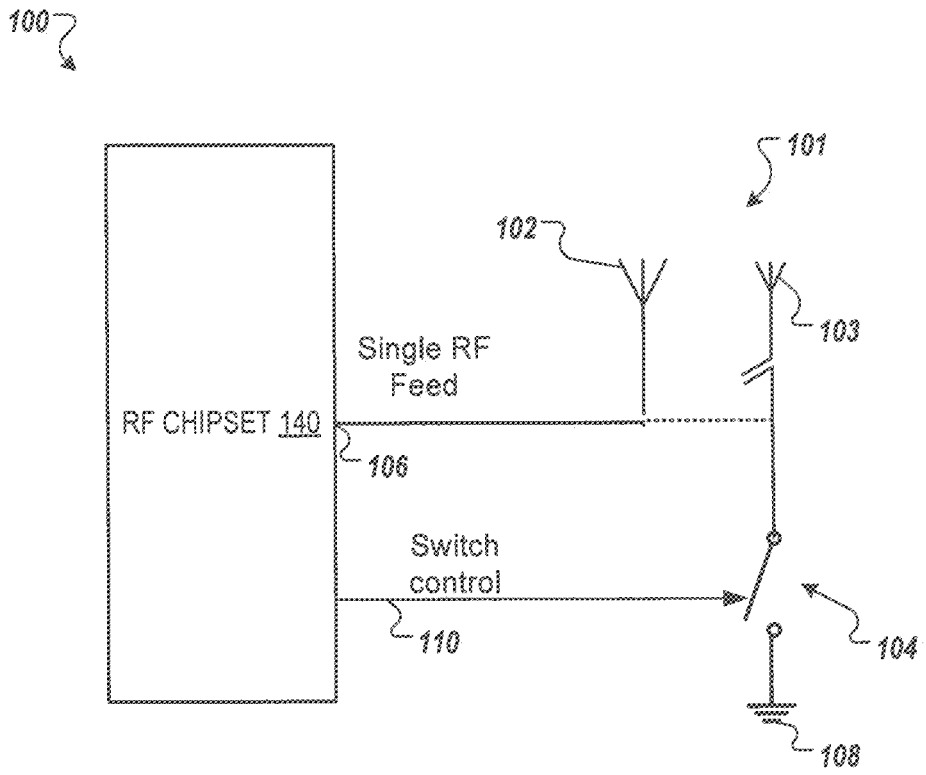
FIG. 1 is a block diagram of an antenna architecture of a user device with a pattern diversity assisted antenna structure according to one embodiment.

Antenna structures and methods of operating the same of an electronic device are described. One apparatus includes a radio coupled to a RF feed and an RF switch, a first antenna element coupled to the RF feed, and a second antenna element coupled to the RF switch, the RF switch being coupled to a grounding point of a ground plane. The radio controls the RF switch between a first mode and a second mode. The radio causes the first antenna element to radiate electromagnetic energy in a first radiation pattern in the first mode and causes the second antenna element to radiate electromagnetic energy in a second radiation pattern in the second mode. The second radiation pattern is different than the first radiation pattern.

In a constrained radiation space (low and thin profiles for mobile devices) of user devices, antenna engineers face various challenges. One challenge is antenna selection diversity to ensure wireless connectivity over channel fading caused by multipath and null spots of the antenna radiation pattern. To achieve the benefit of antenna diversity, a low envelope correlation coefficient (ECC) is needed. ECC is an indication or a measurement of how independent two antennas' radiation patterns are. ECC takes into account the antennas' radiation patterns, including the shapes, polarizations and phases of the antennas. Traditionally, low ECC may be obtained by two or more antennas located in different orientations and/or locations. In such cases, more antenna space is needed to accommodate the additional antennas needed for a low ECC for antenna diversity. However, it is difficult to obtain low ECC with co-located antennas or closely coupled antennas.

The embodiments described herein are directed to pattern diversity assisted antennas. Some embodiments achieve low ECC for a single-input-single-output (SISO) antenna. Other embodiments achieve low ECC for a multiple-input-multiple-output (MIMO) antenna. Alternatively, the embodiments described herein may be used in various single-antenna or multi-antenna configurations. In one embodiment, a single antenna with two switchable modes is set forth for a pattern diversity assisted SISO antenna. The two modes of the antenna share the same antenna geometry but perform differently in terms of current flow and antenna radiation pattern, resulting in low ECC. Without requiring more space for multiple antennas, a single antenna element may be used and the single antenna element's current flow can be redirected in the two modes to effectively different radiation patterns.

In some cases, in order to achieve the best antenna diversity (low ECC), the antenna geometry of the antenna element should be designed to be self-resonant at two different frequencies. In another embodiment, two antennas with four modes are designed. In one embodiment, two antennas with four switchable modes are set forth for a pattern diversity assisted MIMO antenna. The four modes of the two antennas share the same antenna geometry but perform differently in terms of current flow and antenna radiation pattern, resulting in low ECC. Without requiring more space for multiple antennas (e.g., four antennas), existing two-by-two MIMO RF and antenna architecture and the two antenna elements' current flows can be redirected in the four modes to effectively different radiation patterns. In order to achieve the best antenna diversity, the antenna geometry of the antenna elements should be designed to meet the ECC requirement. Some pattern diversity assisted antenna systems include algorithms that utilized pattern diversity assistance. Some embodiments may include basic monopole mode and loop mode antennas.

In other cases, as described in various embodiments described herein, the antenna geometry is designed to serve the same purpose of having the same geometry and two de-correlated modes. These embodiments may include additional geometries, including geometries that can be used in digital media devices, such as a TV dongle or the like. The digital media device may be a microconsole, HDMI-port plug-in devices, or the like. The embodiments described herein are directed to antenna geometries with two de-correlated modes that share the same antenna geometry, but perform differently in terms of current flow and antenna radiation pattern, resulting in low ECC. Without requiring more space for multiple antennas, using a single-fed antenna structure, the embodiments described herein re-direct current flow to achieve different antenna radiation patterns. The antenna geometries described herein have been designed to achieve antenna diversity (low ECC or de-correlated) and impedance matching. In some cases, the antenna's impedance can be matched with different matching components to focus on low ECC first. For example, three RF switches for one antenna may be used; two switches for separate matching components and one switch for switching between the different modes. In other cases, a parasitic radiating element is designed to change the antenna pattern, trading off ECC and impedance matching. For example, a single RF switch can be used between the different modes. This may simplify the antenna design.

Various embodiments described herein are directed to a TV dongle with radio circuitry that communicates over a wireless local area network (WLAN) using the Wi-Fi® technology in the 2.4 GHz frequency band. It should be noted that in other embodiments, the antenna structures described herein can be used for Long Term Evolution (LTE) frequency bands, third generation (3G) frequency bands, personal area network (PAN) frequency band (e.g., using the Bluetooth® technology or Zigbee® technology), wide area network (WAN) frequency bands, global navigation satellite system (GNSS) frequency bands (e.g., positioning system (GPS) frequency bands, other WLAN frequency bands, or the like.

FIG. 1 is a block diagram of an antenna architecture of a user device 100 with a pattern diversity assisted antenna structure 101 according to one embodiment. The user device 100 includes a RF chipset 140 (also referred to herein as RF circuit, RF circuitry or radio), a single RF feed 106, and the pattern diversity assisted antenna structure 101. The pattern diversity assisted antenna structure 101 includes an antenna element 102, a parasitic ground element 103, and an RF switch 104. A first end of the antenna element 102 is coupled to the single RF feed 106. The RF switch 104 is coupled between the parasitic ground element 103 and a grounding point 108, such as on a ground plane. The RF chipset 140 is operable to control the RF switch 104 to switch the pattern diversity assisted antenna structure 101 between the first mode and the second mode. The RF chipset 140 may control the RF switch 104 using a switch control signal 110. The RF chipset 140 is also operable to cause the pattern diversity assisted antenna structure 101 to radiate electromagnetic energy in a first radiation pattern in the first mode and to radiate or electromagnetic energy in a second radiation pattern in the second mode. In particular, the RF chipset 140 causes a current flow on the antenna element 102 to cause the antenna element 102 to radiate or receive electromagnetic energy in the first radiation pattern in the first mode and cause a second current flow on the antenna element 102 and a third current flow on the parasitic ground element 103 to radiate electromagnetic energy in the second radiation pattern in the second mode.

In one embodiment, the RF switch 104 is a single-pole-single-throw (SPST) switch coupled between parasitic ground element 103 and the grounding point 108. The RF chipset 140 is operable to control the SPST switch between a closed state and an open state. The RF switch 104 redirects the current flow applied on the pattern diversity assisted antenna structure 101 by the single RF feed 106. For example, the RF chipset 140 can apply a RF signal to the single RF feed 106 that causes a first current flow on the antenna element 102 to achieve a first radiation pattern of electromagnetic energy in a first resonant mode when the SPST switch is in the open state. The RF chipset 140 can apply a separate RF signal to the single RF feed 106 that causes a second current flow on the antenna element 102 to achieve a first radiation pattern of electromagnetic energy in a second resonant mode when the SPST switch is in the closed state. Alternatively, the RF chipset 140 can apply the RF signal to the single RF feed 106 that causes a redirection of the first current flow to generate a second current flow on the first antenna element and on the second antenna element to radiate the electromagnetic energy in the second radiation pattern. Also, when the SPST is in the closed state, the second current flow on the parasitic ground element 103 parasitically induces a third current on the parasitic ground element 103. The second current flow and the third current flow collectively generate a second radiation pattern of electromagnetic energy in a second resonant mode. The second radiation pattern is different than the first radiation pattern. In one embodiment, the antenna element is self-resonant at approximately 2.4 GHz when the SPST switch is in the open state, and the antenna element 102 and the parasitic ground element 103 are self-resonant at approximately 2.4 GHz when the SPST switch is in the closed state. Alternatively, the antenna is self-resonant at a frequency between approximately 5.0 GHz and approximately 6.0 GHz.

In one embodiment, the antenna element 102 operates as a monopole antenna when the SPST switch is in the open state and the antenna element 102 and the parasitic ground element 103 together operate as a coupled mode antenna when the SPST switch is in the closed state, as described herein. In another embodiment, the antenna element 102 operates as a monopole antenna when the SPST switch is in the open state and the antenna element 102 and the parasitic ground element 103 together operate as a parasitic mode antenna when the SPST switch is in the closed state, as described herein.

In one embodiment, the RF chipset 140 includes a wireless local area network (WLAN) is operable to cause the antenna element 102 to radiate electromagnetic energy in a frequency range (e.g., approximately 2.4 GHz and approximately 2.5 GHz) in the first resonant mode and cause the antenna element 102 and the parasitic ground element 103 to radiate electromagnetic energy in the same frequency range in the second resonant mode. The first resonant mode and the second resonant mode are de-correlated modes. In one embodiment, the first resonant mode is a monopole mode and the second resonant mode is a coupled mode. In another embodiment, the first resonant mode is a monopole mode and the second resonant mode is a parasitic mode. These modes can be further matched to desired working bands of interest. For example, in dual-band Wi-Fi® networks, the antenna element 102 can be matched in the two modes to cover the 2.4 GHz band and the 5 GHz band. For example, the WLAN module may include a WLAN RF transceiver for communications on one or more Wi-Fi® bands (e.g., 2.4 GHz and 5 GHz). It should be noted that the Wi-Fi® technology is the industry name for wireless local area network communication technology related to the IEEE 802.11 family of wireless networking standards by Wi-Fi Alliance. For example, a dual-band WLAN RF transceiver allows an electronic device to exchange data or connection to the Internet wireless using radio waves in two WLAN bands (2.4 GHz band, 5 GHz band) via one or multiple antennas. For example, a dual-band WLAN RF transceiver includes a 5 GHz WLAN channel and a 2.4 GHz WLAN channel. In other embodiments, the antenna architecture may include additional RF modules and/or other communication modules, such as a WLAN module, a GPS receiver, a near field communication (NFC) module, a PAN modules that implements the Bluetooth® or Zigbee® technologies, an amplitude modulation (AM) radio receiver, a frequency modulation (FM) radio receiver, a Global Navigation Satellite System (GNSS) receiver, or the like. The RF chipset 140 may include one or multiple RFFE (also referred to as RF circuitry). The RFFEs may include receivers and/or transceivers, filters, amplifiers, mixers, switches, and/or other electrical components. In another embodiment, the radio is a WLAN radio.

The RF chipset 140 may be coupled to a modem that allows the user device 100 to handle both voice and non-voice communications (such as communications for text messages, multimedia messages, media downloads, web browsing, etc.) with a wireless communication system. The modem may provide network connectivity using any type of digital mobile network technology including, for example, LTE, LTE advanced (4G), CDPD, GPRS, EDGE, UMTS, 1×RTT, EVDO, HSDPA, WLAN (e.g., Wi-Fi® network), etc. In the depicted embodiment, the modem can use the RF chipset 140 to radiate or receive electromagnetic energy on the antennas to communication data to and from the user device 100 in the respective frequency ranges. In other embodiments, the modem may communicate according to different communication types (e.g., WCDMA, GSM, LTE, CDMA, WiMAX, etc.) in different cellular networks.

The user device 100 (also referred to herein as an electronic device) may be any content rendering device that includes a modem for connecting the user device to a network. Examples of such electronic devices include electronic book readers, portable digital assistants, mobile phones, laptop computers, portable media players, tablet computers, cameras, video cameras, netbooks, notebooks, desktop computers, gaming consoles, Blu-ray® or DVD players, media centers, drones, and the like. The user device may connect to a network to obtain content from a server computing system (e.g., an item providing system) or to perform other activities. The user device may connect to one or more different types of cellular networks.

As described above, a diversity antenna, or a MIMO antenna, is a secondary antenna that may be used along with the one or more primary antennas to improve the quality and reliability of a wireless link. There may be no clear line-of-sight between a transmitter and a receiver. Instead, a signal may undergo multiple reflections between transmission and reception. Each reflection may introduce time delays, phase shifts, distortions, attenuations, etc. that can degrade a signal quality. The diversity antennas have a different location and/or configuration than the primary antennas on the user device, and may therefore experience different phase shifts, time delays, attenuations, distortions, etc. Accordingly, signals at the diversity antenna can be compared to signals at the primary antenna to determine and mitigate such effects. Using the embodiments described herein, a single antenna structure can be used in two resonant modes to create two radiation patterns to achieve a diversity pattern assisted antenna. That is, the RF chipset 140 can use the same antenna structure for two different radiation patterns to achieve diversity.

The pattern diversity assisted antenna structure 101 of FIG. 1 may be a SISO antenna system. The embodiments described herein may also be used in a MIMO antenna system as described with respect to FIG. 2.

Figure 2:
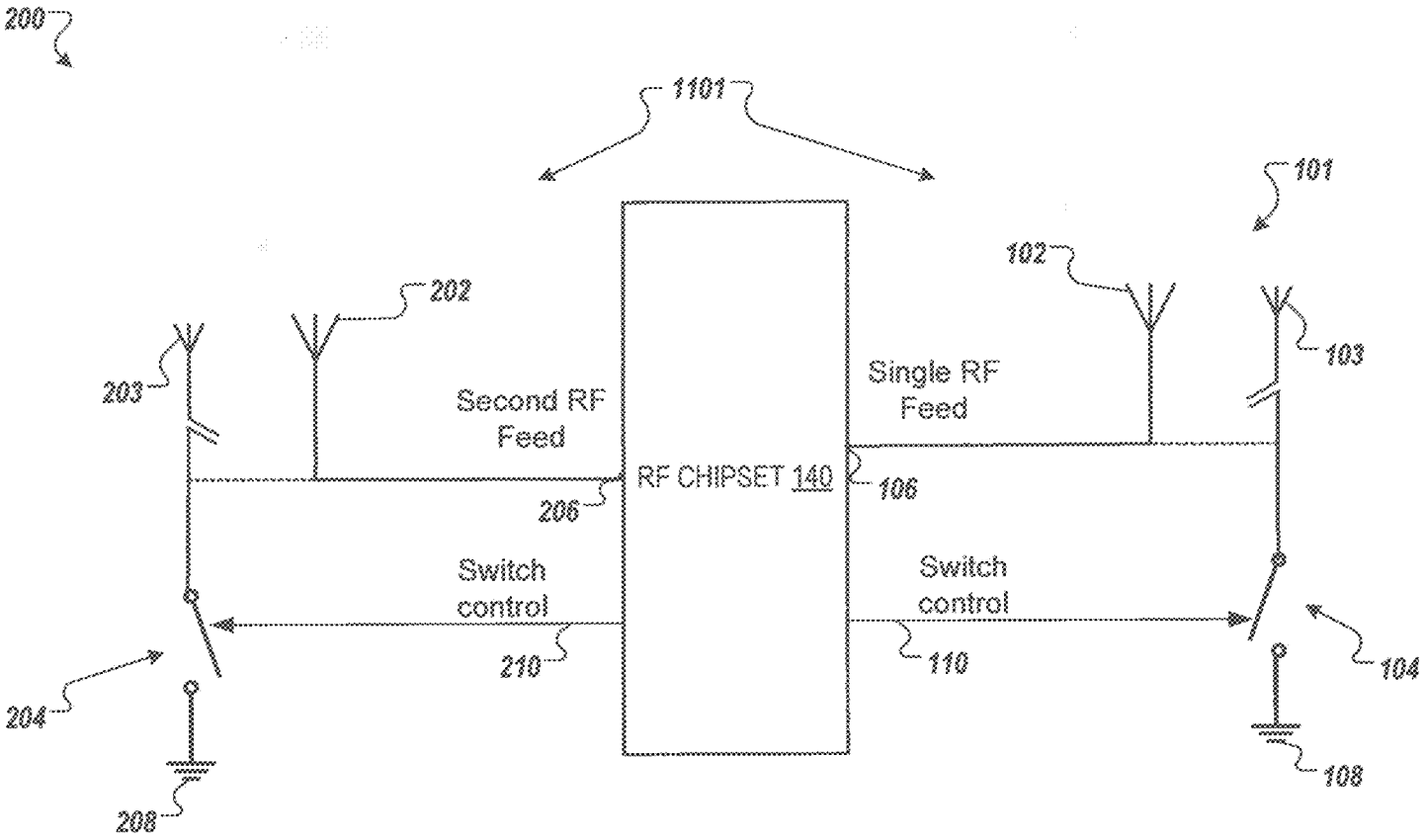
FIG. 2 is a block diagram of an antenna architecture of a user device with a pattern diversity assisted antenna structure according to another embodiment.

FIG. 2 illustrates a user device 200 with a pattern diversity assisted antenna 201 according to one embodiment. The user device 200 is similar to user device 100 as noted by similar reference labels. The pattern diversity assisted antenna 201 includes the same components as pattern diversity assisted antenna structure 101 of FIG. 1, but includes a duplicate antenna structure, including an antenna element 202, a parasitic ground element 203, and an RF switch 204. A first end of the antenna element 202 is coupled to the single RF feed 206. The RF switch 204 is coupled between the parasitic ground element 203 and a grounding point 208, such as on a ground plane. The RF chipset 140 is operable to control the RF switch 204 to switch the pattern diversity assisted antenna structure 201 between the first mode and the second mode. The RF chipset 140 may control the RF switch 204 using a switch control signal 210. The RF chipset 140 is also operable to cause the pattern diversity assisted antenna structure 201 to radiate electromagnetic energy in a first radiation pattern in the first mode and to radiate or electromagnetic energy in a second radiation pattern in the second mode. In particular, the RF chipset 140 causes a current flow on the antenna element 202 to cause the antenna element 202 to radiate or receive electromagnetic energy in the first radiation pattern in the first mode and cause a second current flow on the antenna element 202 and a third current flow on the parasitic ground element 203 to radiate electromagnetic energy in the second radiation pattern in the second mode. These two modes may be used in connection with the two modes described with respect to FIG. 1.

The embodiments of the pattern diversity assisted antenna structures of FIG. 1 and FIG. 2 can be implemented in various electronic devices, including a TV dongle or other digital media device. The following embodiments described and illustrate a TV dongle that can be inserted into a plug-in port of a TV. In other embodiments, the pattern diversity assisted antenna structure can be implemented in other electronic devices with constrained space for antennas.

Figure 3:
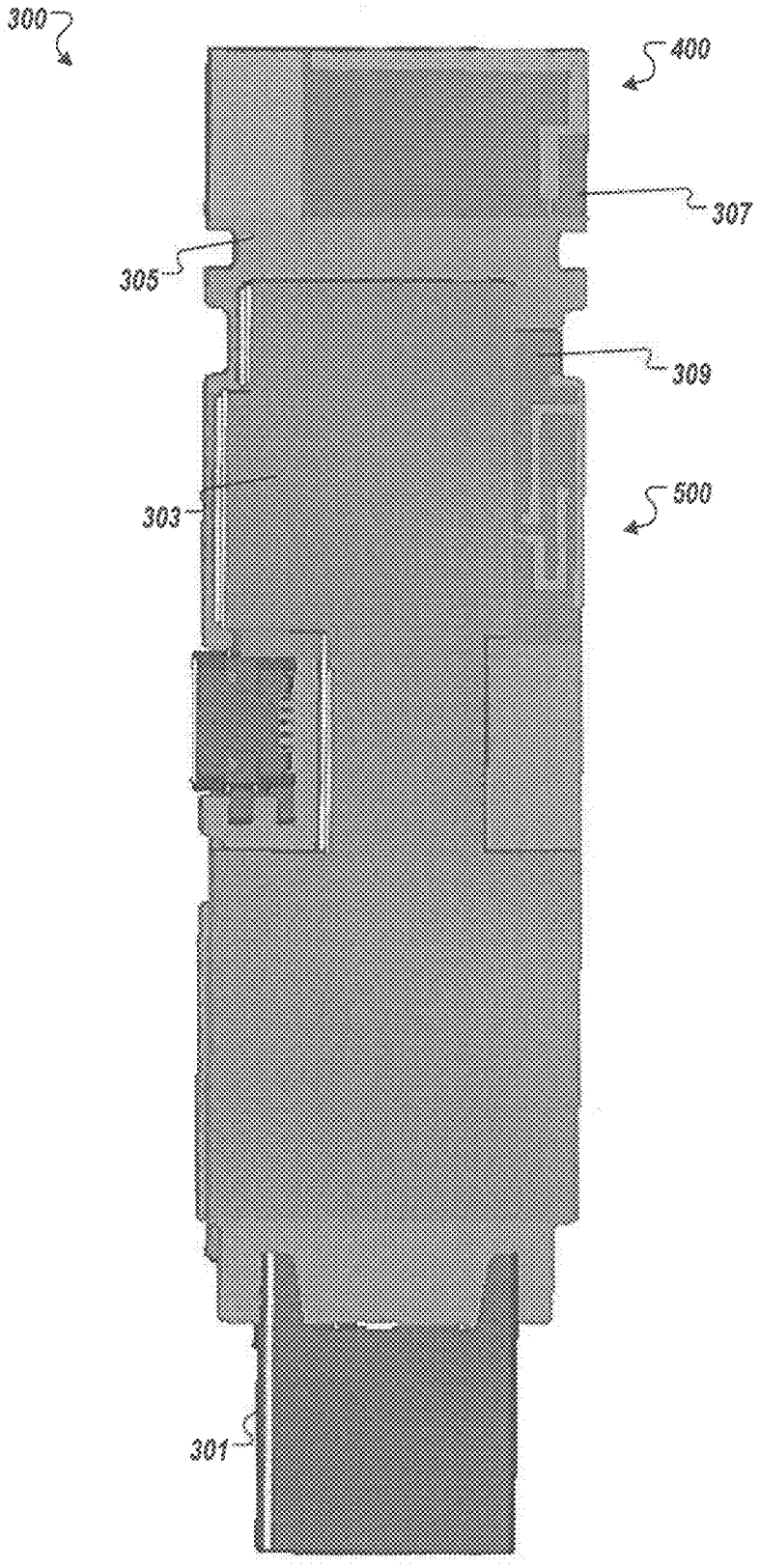
FIG. 3 illustrates a TV dongle with a multi-antenna system according to one embodiment.

FIG. 3 illustrates a TV dongle 300 with a multi-antenna system according to one embodiment. The TV dongle 300 includes a connector 301 that extends out from a housing (not illustrated in FIG. 3) for insertion into a plug-in port of TV or other type of electronic device. The TV dongle 300 includes a printed circuit board (PCB) 303 disposed within the housing and coupled to the connector 301. The PCB 303 includes a ground plane 305. A RF circuit is disposed on the PCB 303. Antenna carriers 307, 309 are disposed within the housing and are coplanar with the ground plane 305. A first pattern diversity assisted antenna structure 400 is disposed on the antenna carrier 307 at a top end of the TV dongle 300, the top end being the farthest from the connector 301. The first pattern diversity assisted antenna structure 400 is coupled to the RF circuit via a first single RF feed. A second pattern diversity assisted antenna structure 700 is disposed on the antenna carrier 309 at one side of the TV dongle 300. The second pattern diversity assisted antenna structure 700 is coupled to the RF circuit via a second single RF feed.

In this embodiment, the multi-antenna system includes two pattern diversity assisted antenna structures 400, 700. The first pattern diversity assisted antenna structure 400 is illustrated and described in more detail with respect to FIGS. 4-6. The second pattern diversity assisted antenna structure 700 is illustrated and described in more detail with respect to FIGS. 7-9.

Figure 4:
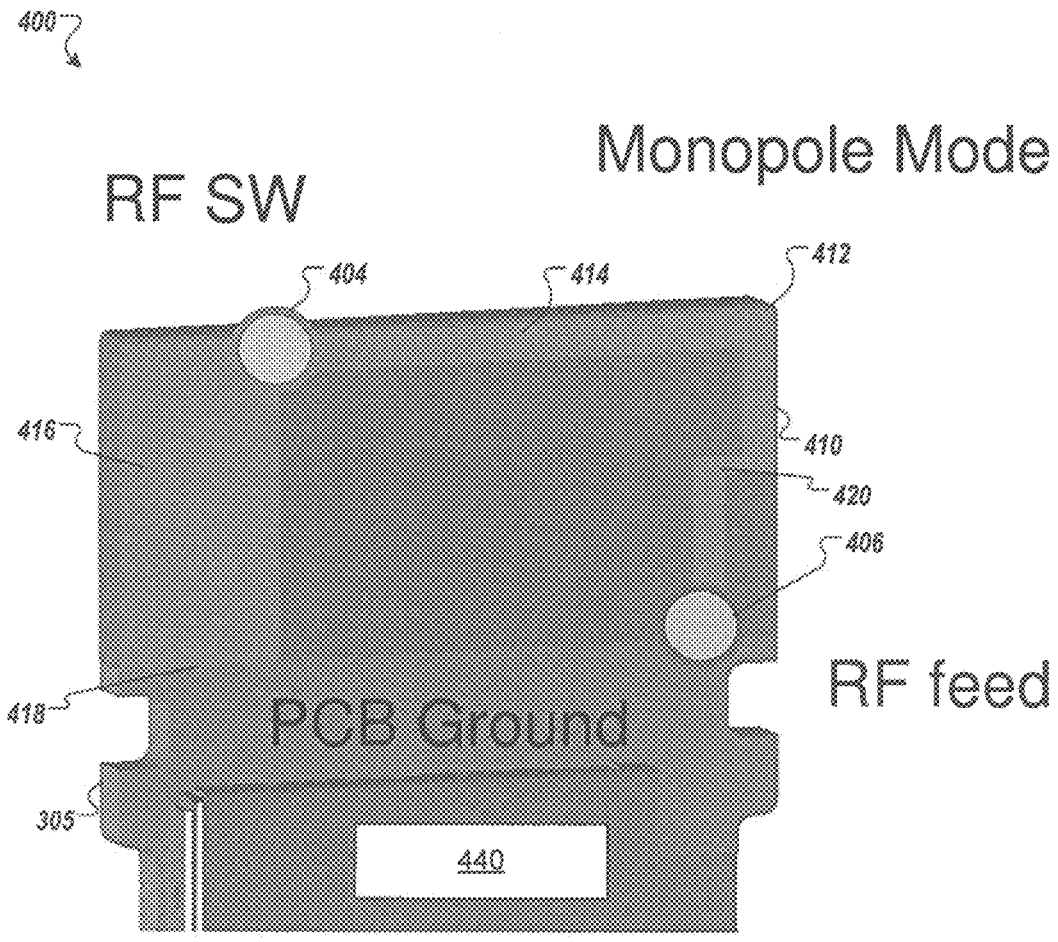
FIG. 4 illustrates a pattern diversity assisted antenna structure according to one embodiment.

FIG. 4 illustrates a pattern diversity assisted antenna structure 400 according to one embodiment. The pattern diversity assisted antenna structure 400 includes a first arm 410 coupled to a single RF feed 406 at a first end. The first arm 410 extends in a first direction from the single RF feed 406 to a first fold 412 at a second end of the first arm 410. A second arm 414 is coupled to the second end of the first arm 410 at the first fold 412. The second arm 414 extends in a second direction from a first end of the second arm 414 at the first fold 412 to a second end of the second arm 414. The pattern diversity assisted antenna structure 400 also includes a RF switch 404 coupled between the second arm 414 and a ground arm 416 that is coupled to the ground plane 305 at a grounding point 418 of the ground plane 305 of the PCB. The ground arm 416 can be a wider segment than the first arm 410 or the second arm 414. Also, the first arm 410 can have a jog 420 in the conductive material, as illustrated in FIG. 4. The RF switch 404 may be a SPST switch. For example, a first terminal of the SPST switch is coupled to the second end of the second arm 414 and a second terminal of the SPST switch is coupled to the grounding point 418 on the ground plane 305.

In one embodiment, the pattern diversity assisted antenna structure 400 is approximately 20 mm wide and approximately 9 mm tall as disposed on the antenna carrier 407. Alternatively, the pattern diversity assisted antenna structure 400 may be other dimensions. In one embodiment, as illustrated in FIG. 4, the second arm 414

RF circuitry 440 is operable to control the RF switch 404 to switch the pattern diversity assisted antenna structure 400 between the first mode and the second mode. The RF circuitry 440 may control the RF switch 404 using a switch control signal (not illustrated in FIG. 4). Alternatively, other components can control the state of the RF switch 404. The RF circuitry 440 is also operable to cause the pattern diversity assisted antenna structure 400 to radiate electromagnetic energy in a first radiation pattern in the first mode and to radiate or electromagnetic energy in a second radiation pattern in the second mode. In this embodiment, the pattern diversity assisted antenna structure 400 operates as a loop antenna in the first mode and as a monopole antenna in the second mode, as illustrated in FIG. 5A and FIG. 4, respectively.

In one embodiment, the pattern diversity assisted antenna structure is a two arm structure that includes two modes: monopole mode and loop mode. The monopole arm is the antenna main radiation element. A wide ground arm provides RF current return path back to the ground plane and change return current direction. The RF switch provides an RF open or short circuit to modulate the current flow. The RF feed provides RF excitation to the antenna structure.

Figure 5A:
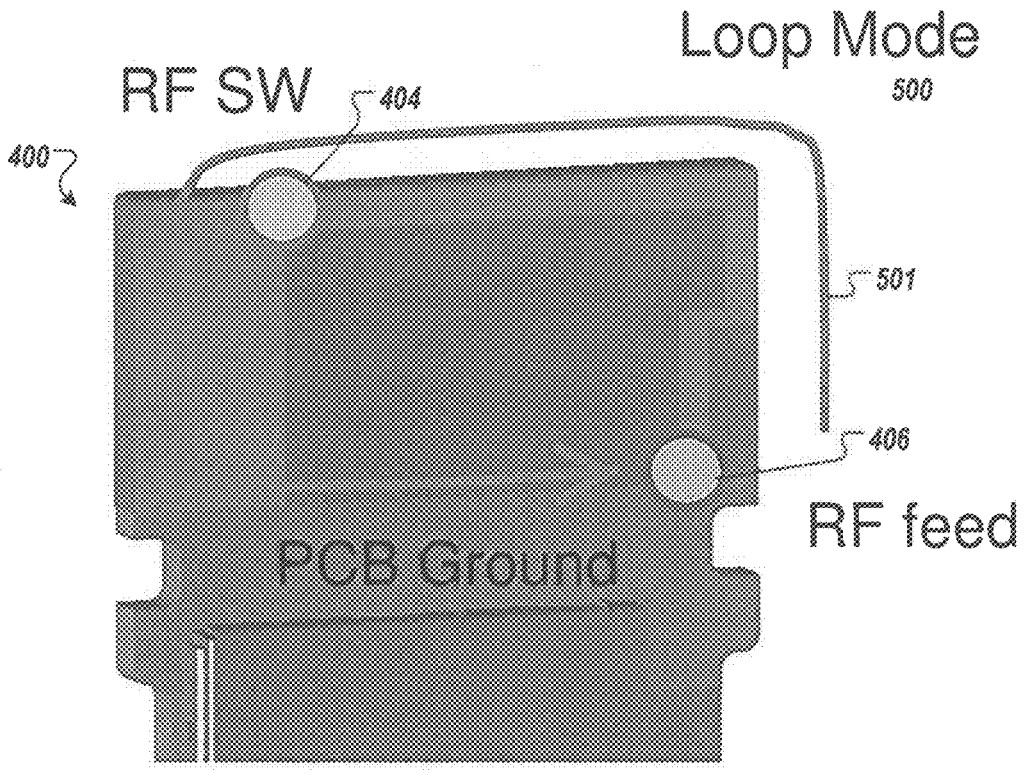
FIG. 5A illustrates a first current flow of the pattern diversity assisted antenna structure of FIG. 4 in a first mode according to one embodiment.

FIG. 5A illustrates a first current flow 501 of the pattern diversity assisted antenna structure 400 of FIG. 4 in a first mode 500 according to one embodiment. When in the first mode 500, the RF switch 404 is shorted. Thus, the first current flow 501 flows from the single RF feed 406 through the first arm 410 and second arm 414 through the shorted RF switch 404 to the grounding point 418 in a loop. The first current flow 501 results in the pattern diversity assisted antenna structure 400 operating as a loop antenna to create the first radiation pattern.

Figure 5B:
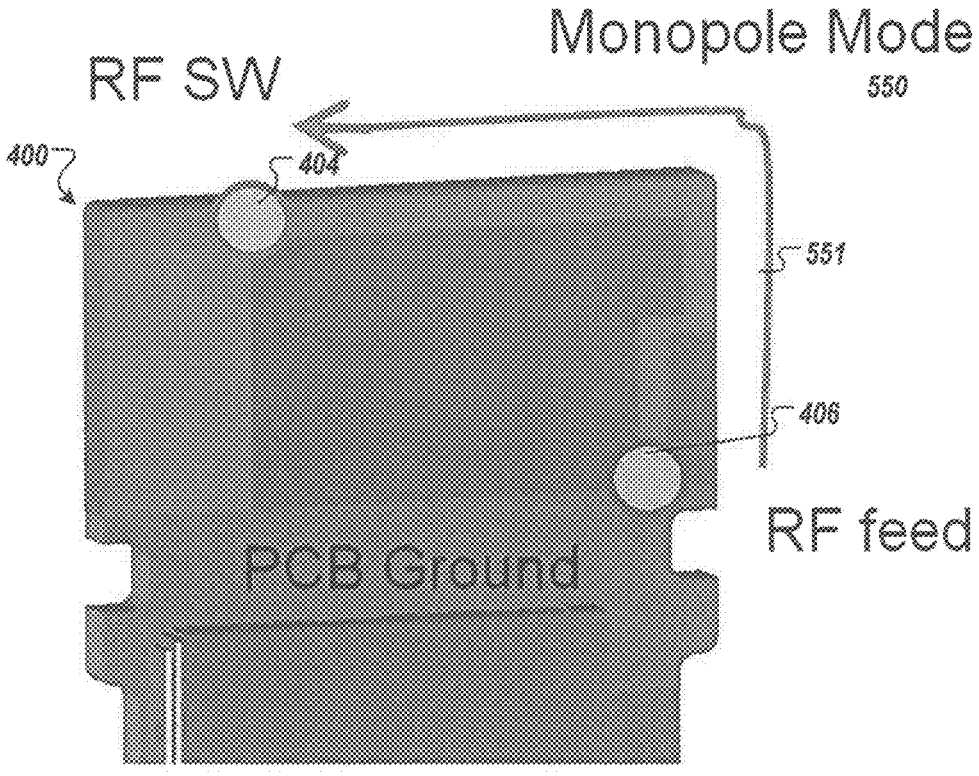
FIG. 5B illustrates a second current flow of the pattern diversity assisted antenna structure of FIG. 4 in a second mode according to one embodiment.

FIG. 5B illustrates a second current flow 551 of the pattern diversity assisted antenna structure 400 of FIG. 4 in a second mode 550 according to one embodiment. When in the second mode 550, the RF switch 404 is open. Thus, the second current flow 551 flows from the single RF feed 406 through the first arm 410 and second arm 414. However, the second current flow 551 does not pass to the grounding point 418 through the open RF switch 404. The second current flow 551 results in the pattern diversity assisted antenna structure 400 operating as a monopole antenna to create the second radiation pattern.

Figure 6:
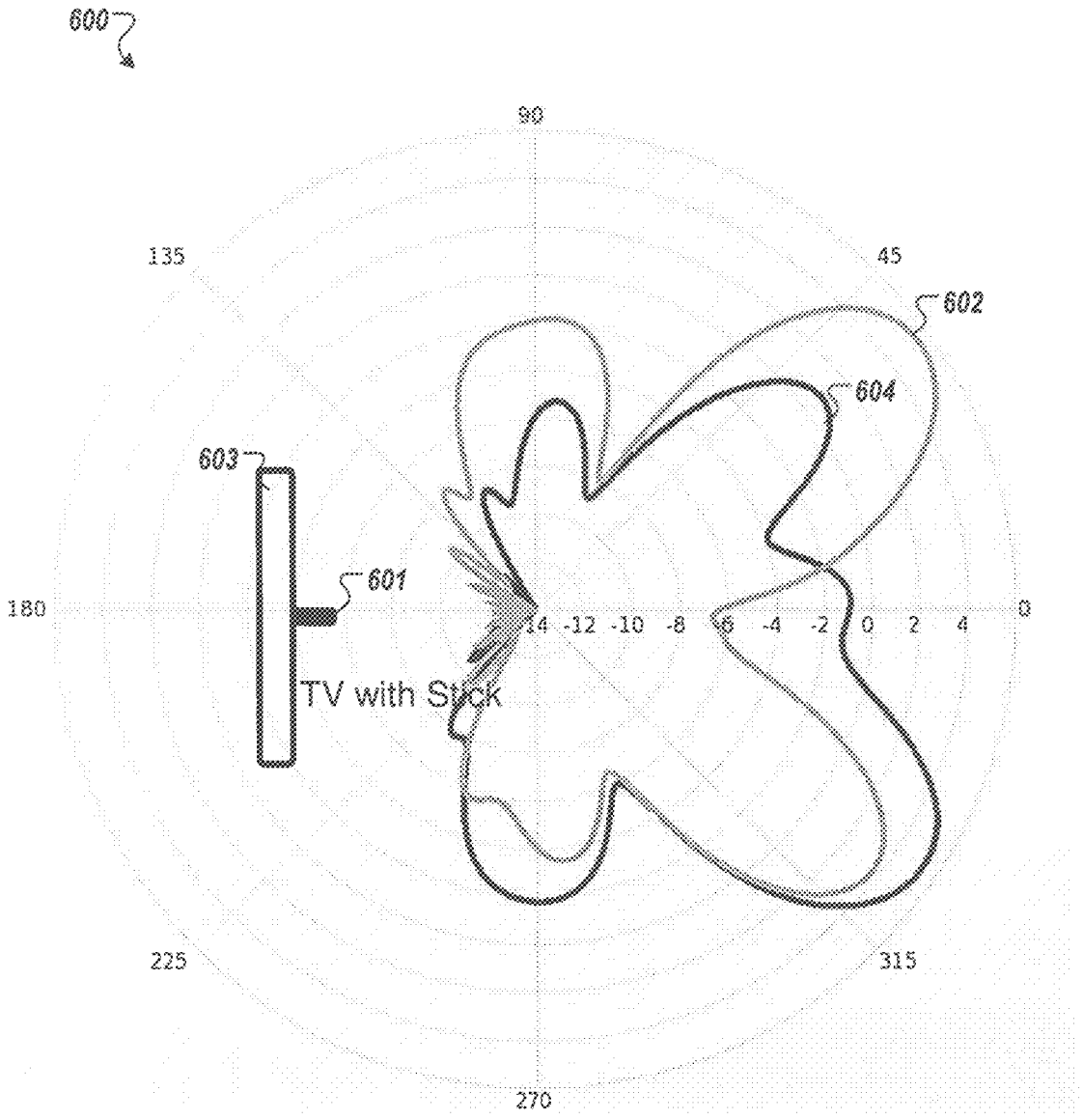
FIG. 6 is a graph of radiation patterns of the pattern diversity assisted antenna structure of FIG. 4 according to one embodiment.

FIG. 6 illustrates a graph 600 of radiation patterns of the pattern diversity assisted antenna structure 400 of FIG. 4 according to one embodiment. A TV dongle 601, including the pattern diversity assisted antenna structure 400 of FIG. 4, is plugged into a TV 603. When in the first mode 500, the pattern diversity assisted antenna structure 400 operates as a loop antenna and generates a first radiation pattern 602. When in the second mode 550, the pattern diversity assisted antenna structure 400 operates as a monopole antenna and generates a second radiation pattern 604. The first radiation pattern 602 is different than the second radiation pattern 604.

Figure 7:
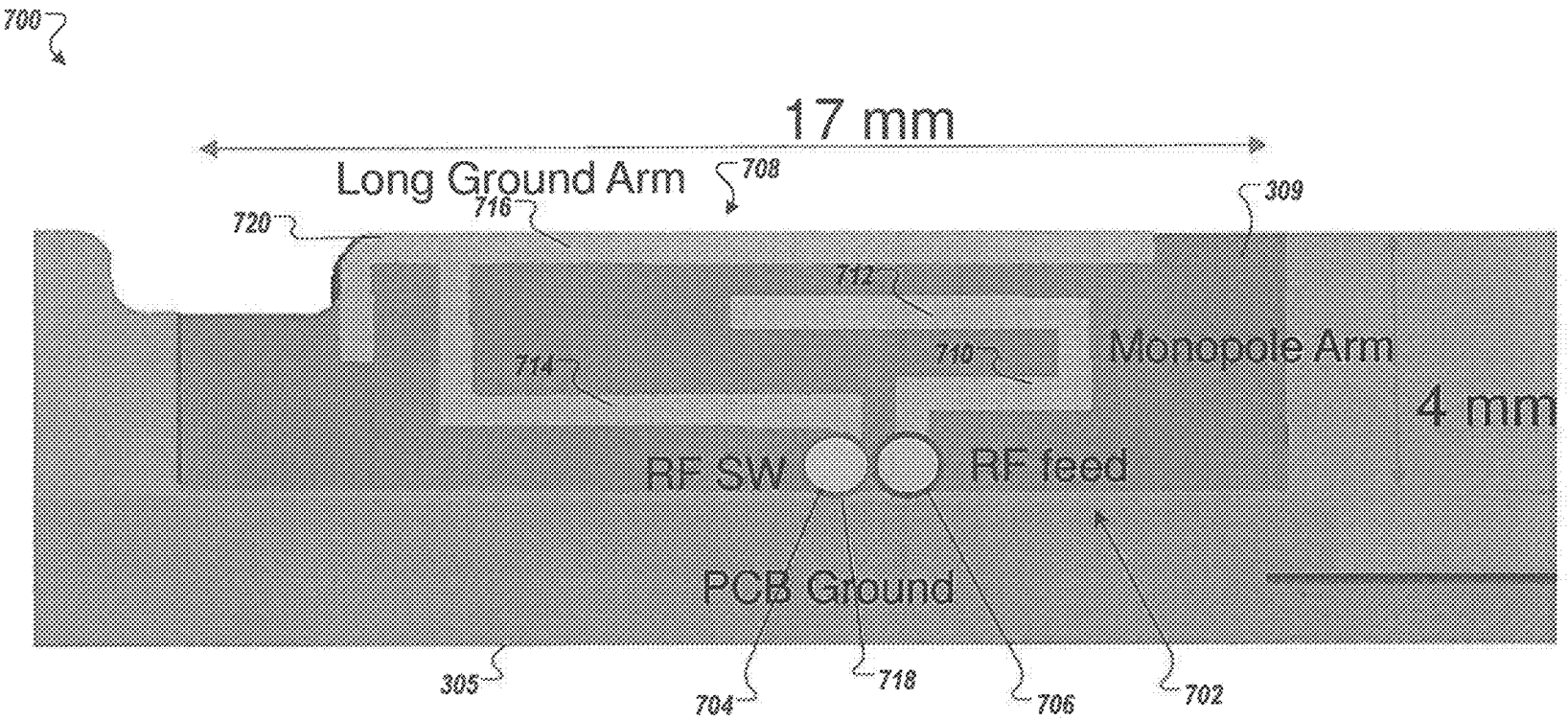
FIG. 7 illustrates a pattern diversity assisted antenna structure according to one embodiment.

FIG. 7 illustrates a pattern diversity assisted antenna structure 700 according to one embodiment. The pattern diversity assisted antenna structure 700 includes an antenna element 702 disposed on the antenna carrier 309, the antenna element 702 being coupled to the RF circuit 440 (not illustrated in FIG. 7) via an RF feed 706. The pattern diversity assisted antenna structure 700 also includes a parasitic ground element 708 disposed on the antenna carrier 309 and a RF switch 704 coupled to the parasitic ground element 708 and a grounding point 718 on the ground plane 305.

In one embodiment, the antenna element 702 includes a first arm having a first effective length between a first end coupled to the RF feed 706 and a second end at a distal end of the first arm. The parasitic ground element 708 includes a second arm having a second effective length between a first end and a second end of the second arm, the first end of the second arm being coupled to the ground plane 305 at the grounding point 718. The first arm and the second arm are coplanar. In the depicted embodiment, a segment 712 of the first arm extends in a first direction such that the second end of the first arm is disposed in a first gap formed between a first segment 714 and a second segment 716 of the second arm, the second segment 716 extending in a second direction beyond the second end of the first arm to form a second gap between a portion of the second segment 716 and the segment 712 of the first arm. The first arm may also include another segment 710 that couples the segment 712 to the RF feed 706.

In a further embodiment, the parasitic ground element includes an additional arm 720 that extends in the first direction and folds towards the ground plane 305 in a third direction. The additional arm 720 may be used for impedance matching, resulting in an increased bandwidth.

In one embodiment, the pattern diversity assisted antenna structure is a two arm structure that includes two modes: monopole mode and coupled mode. The monopole arm is the antenna main radiation element. A long ground arm provides RF current return path back to the ground plane and provides low band resonance. The RF switch provides an RF open or short circuit to modulate the current flow. The RF feed provides RF excitation to the antenna structure.

Figure 8A:
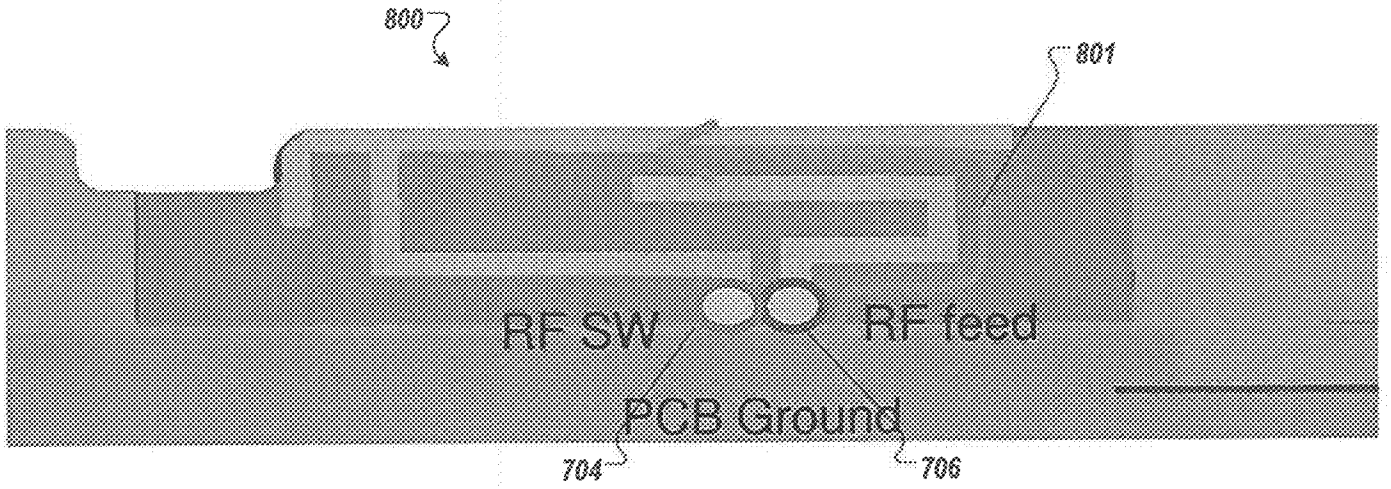
FIG. 8A illustrates a first current flow of the pattern diversity assisted antenna structure of FIG. 7 in a first mode according to one embodiment.

FIG. 8A illustrates a first current flow of the pattern diversity assisted antenna structure of FIG. 7 in a first mode 800 according to one embodiment. During operation, the RF circuit 440 causes a first current flow 801 on the antenna element 702 to generate a first radiation pattern of electromagnetic energy in a first resonant mode 800 when the RF switch 704 is in an open state where the parasitic ground element 708 is not conductively coupled to the grounding point 718. When in the first mode 800, the RF switch 704 is open. Thus, the first current flow 801 flows from the single RF feed 706 through the first arm. No current flow passes to the grounding point 818 through the open RF switch 704. The first current flow 801 results in the pattern diversity assisted antenna structure 400 operating as a monopole antenna to create the first radiation pattern.

Figure 8B:
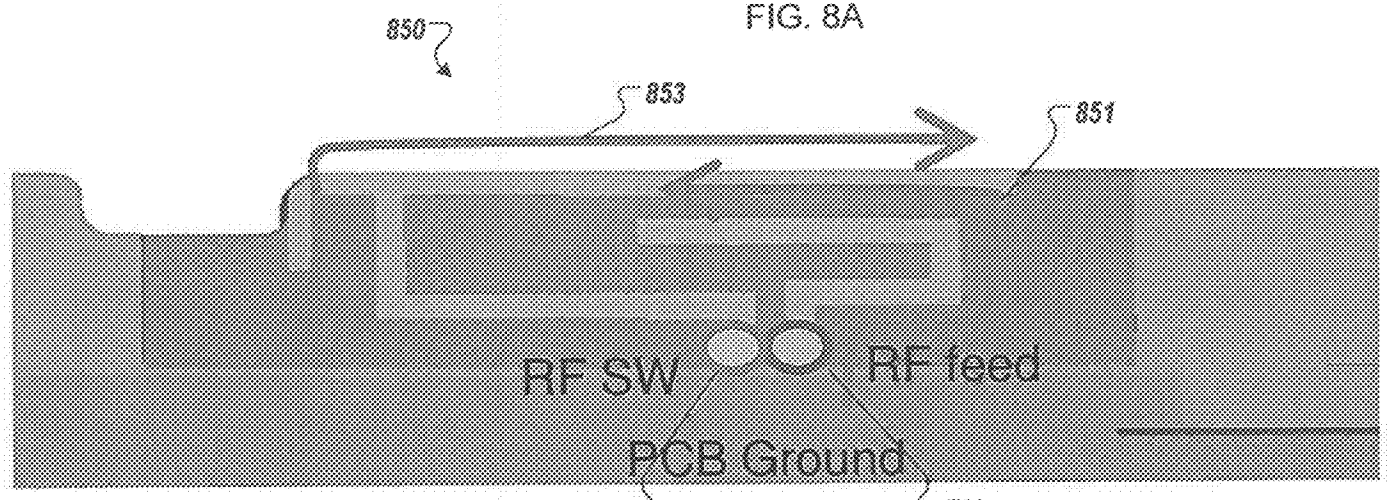
FIG. 8B illustrates a second current flow of the pattern diversity assisted antenna structure of FIG. 7 in a second mode according to one embodiment.

FIG. 8B illustrates a second current flow of the pattern diversity assisted antenna structure of FIG. 7 in a second mode according to one embodiment. During operation, the RF circuit 440 causes a first current flow 851 on the antenna element 702. A second current flow 853 is parasitically induced on the second parasitic ground element 708. The first current flow 851 and the second current flow 853 generate a second radiation pattern of electromagnetic energy in a second resonant mode 850 when the RF switch 704 is in a closed state where the parasitic ground element 708 is conductively coupled to the grounding point 718. When in the second mode 850, the RF switch 404 is shorted. Thus, the first current flow 851 flows from the single RF feed 406 through the first arm and the second current flow 853 flows from the grounding point 718 through the shorted RF switch 704 to the parasitic ground element 708. The first current flow 851 and second current flow 853 results in the pattern diversity assisted antenna structure 400 operating as a coupled mode antenna to create the second radiation pattern.

Figure 9:
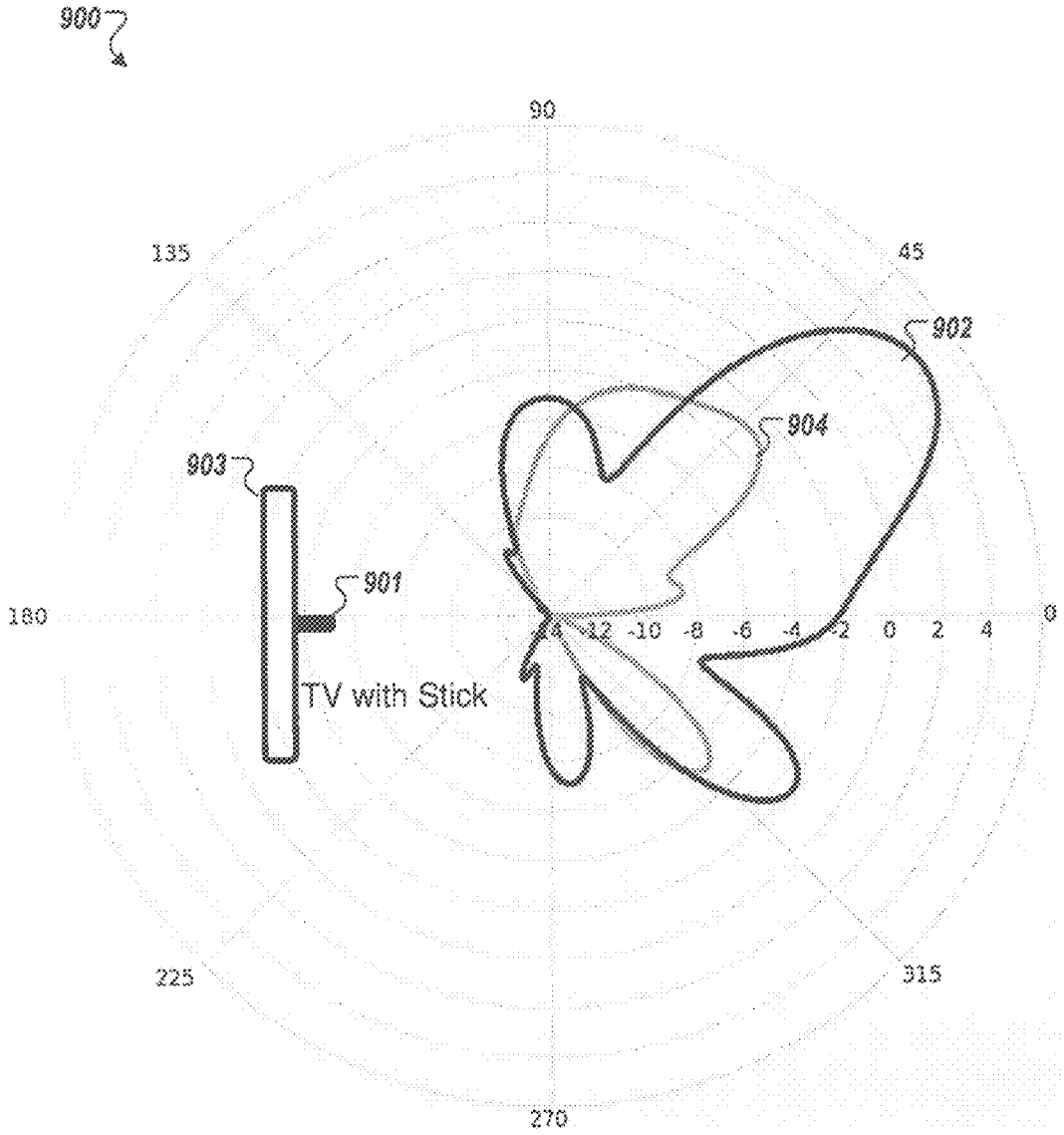
FIG. 9 is a graph of radiation patterns of the pattern diversity assisted antenna structure of FIG. 7 according to one embodiment.

FIG. 9 is a graph of radiation patterns of the pattern diversity assisted antenna structure of FIG. 7 according to one embodiment. A TV dongle 901, including the pattern diversity assisted antenna structure 700 of FIG. 7, is plugged into a TV 903. When in the first mode 800, the pattern diversity assisted antenna structure 700 operates as a monopole antenna and generates a first radiation pattern 902. When in the second mode 850, the pattern diversity assisted antenna structure 700 operates as a coupled mode antenna and generates a second radiation pattern 904. The first radiation pattern 902 is different than the second radiation pattern 904.

In some embodiments, the antenna mode impedance is very different in the first and second modes. The two modes can be matched to desired working bands of interest (e.g., 2.4 GHz). In one embodiment, the first mode is matched using a first impedance matching circuit and the second modes is matched using a second impedance matching circuit. In another embodiment, a single impedance matching circuit can be used to match both the first mode and the second mode. The impedance matching circuits operate to match an impedance of a respective antenna to an impedance of a RF circuit coupled to the respective antenna to radiate or receive electromagnetic energy in a specified frequency range.

Figure 10:
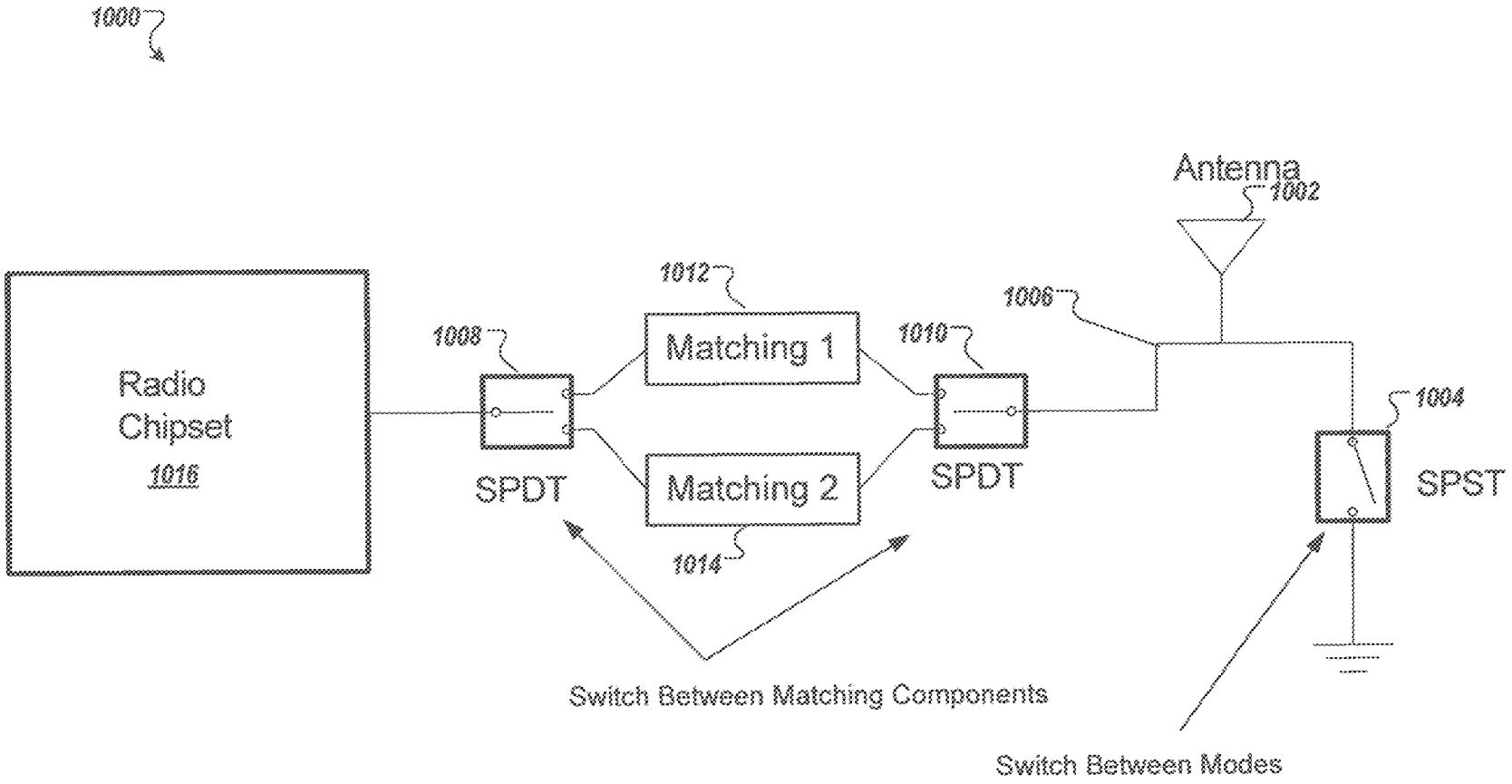
FIG. 10 is a block diagram illustrating two paths of matching components for a pattern diversity assisted antenna structure according to one embodiment.

FIG. 10 is a block diagram 1000 illustrating two paths of matching components for a pattern diversity assisted antenna structure according to one embodiment. In this embodiment, the pattern diversity assisted antenna structure 1002 is coupled to ground via a switch 1004 and is coupled to a RF feed 1006. Between the RF feed 1006 and a radio 1016 (also referred to as radio chipset), multiple paths of matching components may be used to match an impedance of the pattern diversity assisted antenna structure in the different modes. In one embodiment, a first single-pole-double-throw (SPDT) switch 1008 is coupled to the radio 1016 and a second SPDT RF switch is coupled to the RF feed 1006. A first impedance matching network 1012 is coupled between the first SPDT switch 1008 and the second SPDT switch 1010 in a first path. A second impedance matching network 1014 is coupled between the first SPDT switch 1008 and the second SPDT switch 1010 in a second path. An impedance matching network is any combination of components used to match an impedance of the radio to an impedance of the antenna structure 1002 in the respective mode. In other embodiments, more paths may be used with different impedance matching networks.

Figure 11A:
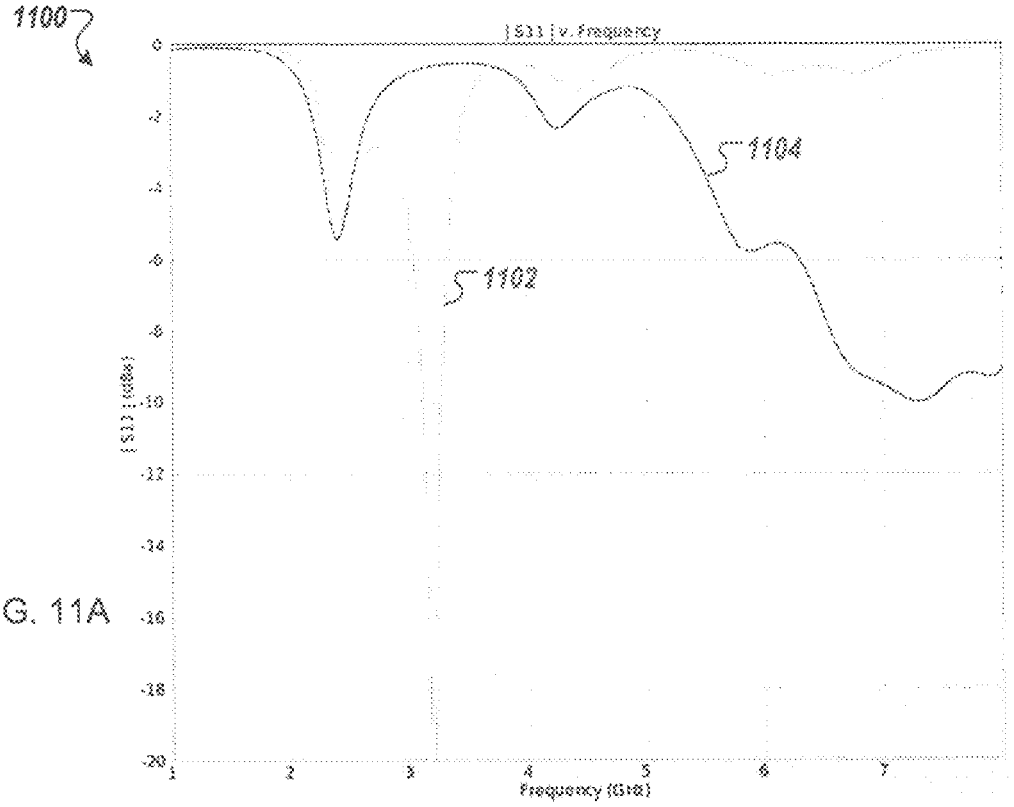
FIG. 11A is a graph of the $S_{11}$ parameter of the pattern diversity assisted antenna structure in FIG. 4 according to one embodiment.

FIG. 11A is a graph 1100 of the S11 parameter of the pattern diversity assisted antenna structure 400 in FIG. 4 according to one embodiment. The graph 1100 shows the S11 parameter 1102 of pattern diversity assisted antenna structure 400 in the first mode (e.g., loop mode). The graph 1100 also illustrates that pattern diversity assisted antenna structure 400 in the second mode (e.g., monopole mode).

Figure 11B:
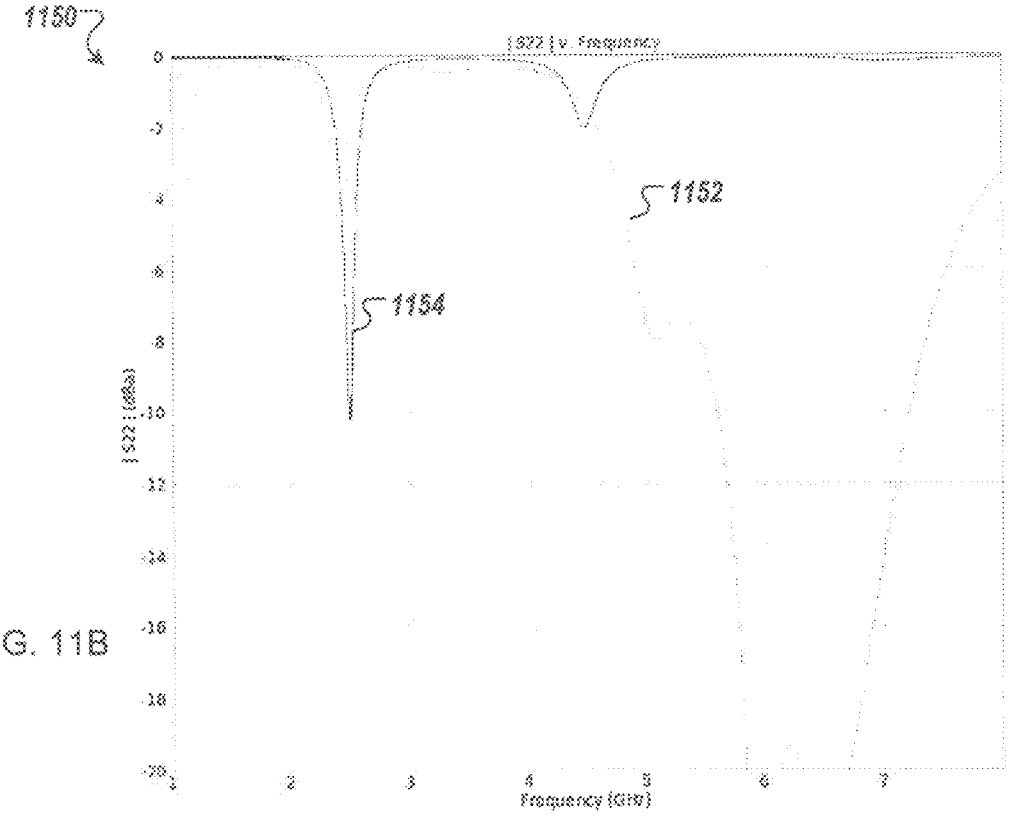
FIG. 11B is a graph of the $S_{11}$ parameter of a pattern diversity assisted antenna structure in FIG. 7 according to one embodiment.

FIG. 11B is a graph 1150 of the $S_{11}$ parameter of a pattern diversity assisted antenna structure 700 in FIG. 7 according to one embodiment. The graph 1150 shows the S11 parameter 1152 of pattern diversity assisted antenna structure 700 in the first mode (e.g., monopole mode). The graph 1150 also illustrates that pattern diversity assisted antenna structure 700 in the second mode (e.g., coupled mode).

Figure 12:
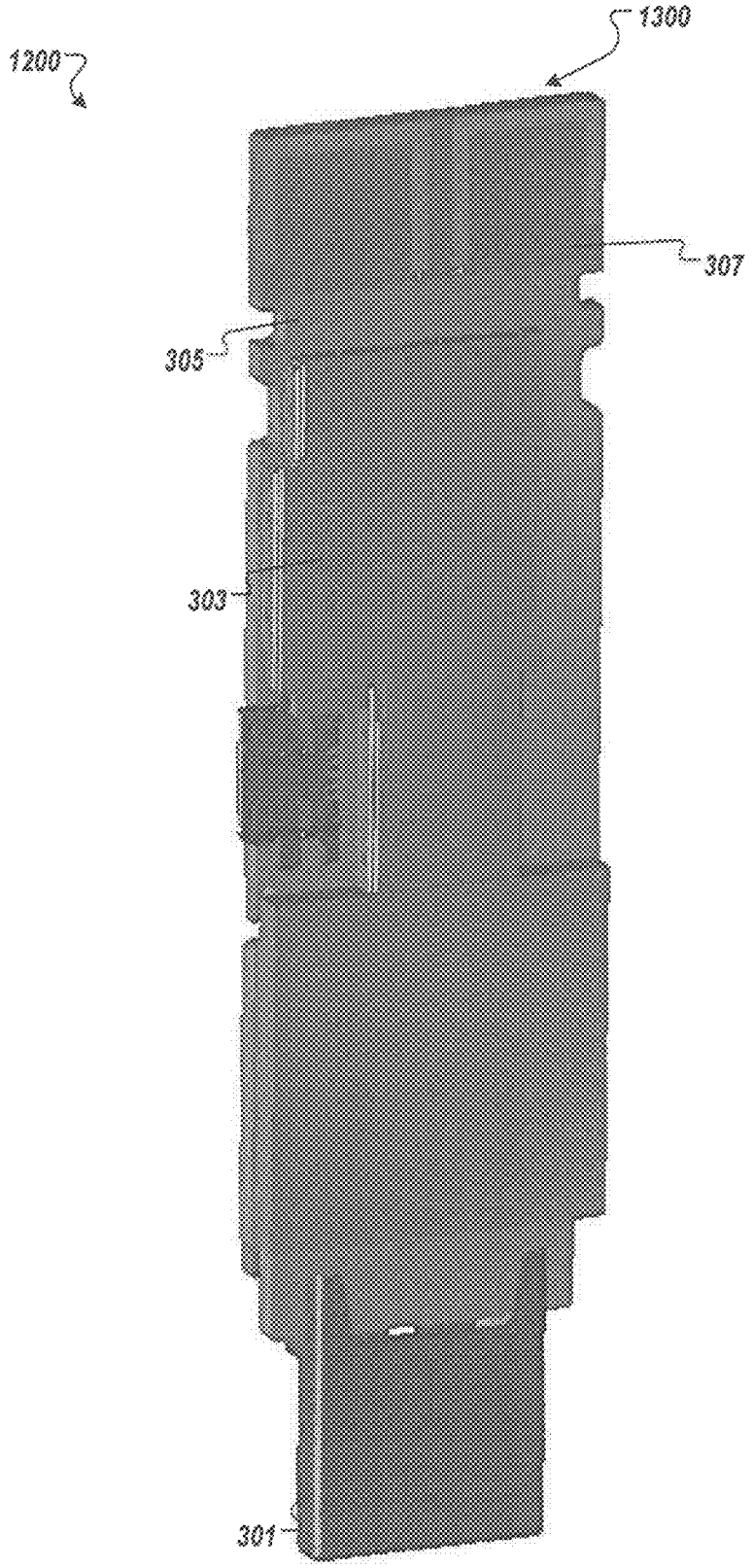
FIG. 12 illustrates a TV dongle with a multi-antenna system according to another embodiment.

FIG. 12 illustrates a TV dongle 1200 with a multi-antenna system according to another embodiment. The TV dongle 1200 is similar to the TV dongle 300 of FIG. 3 as noted by similar reference numbers. However, in this embodiment, pattern diversity assisted antenna structure 1300 is disposed on the antenna carrier 307 at a top end of the TV dongle 1200, the top end being the farthest from the connector 301. The first pattern diversity assisted antenna structure 1300 is coupled to the RF circuit via a first single RF feed. A second pattern diversity assisted antenna structure is not illustrated in FIG. 12, but one or more pattern diversity assisted antenna structures may be disposed on one or more other antenna carriers within the housing of the TV dongle 1200. The pattern diversity assisted antenna structure 1300 is illustrated and described in more detail with respect to FIGS. 13-15.

Figure 13:
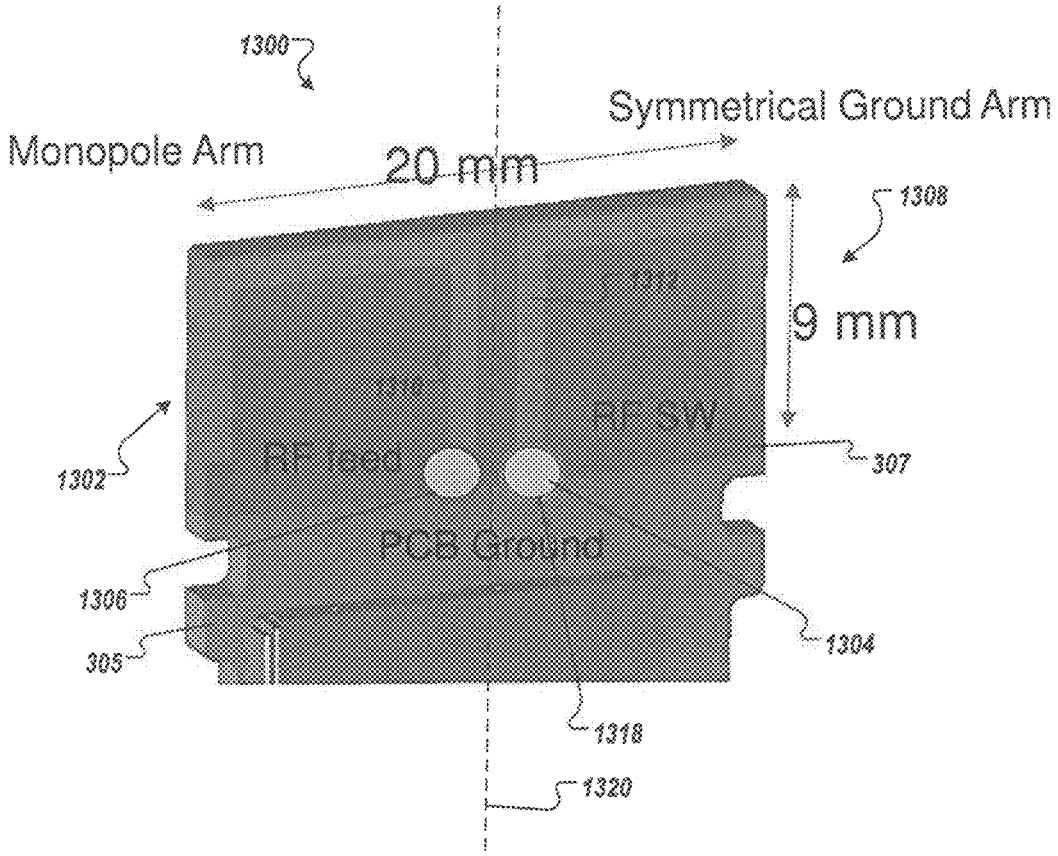
FIG. 13 illustrates a pattern diversity assisted antenna structure according to one embodiment.

FIG. 13 illustrates a pattern diversity assisted antenna structure 1300 according to one embodiment. The pattern diversity assisted antenna structure 1300 includes an antenna element 1302 disposed on the antenna carrier 307, the antenna element 1302 being coupled to the RF circuit 440 (not illustrated in FIG. 13) via an RF feed 1306. The pattern diversity assisted antenna structure 1300 also includes a parasitic ground element 1308 disposed on the antenna carrier 307 and a RF switch 1304 coupled to the parasitic ground element 1308 and a grounding point 1318 on the ground plane 305.

In one embodiment, the antenna element 1302 includes a first arm 1310 and the parasitic ground element 1308 includes a second arm 1312. The first arm 1310 and the second arm 1312 are coplanar. A segment of the first arm 1310 extends in a first direction and a segment of the second arm 1312 extends in the first direction to form a gap between the segment of the first arm 1310 and the segment of the second arm 1312. The first arm 1310 and the second arm 1312 are symmetrical about an axis 1320 defined along a length of the gap between the segment of the first arm 1310 and the segment of the second arm 1312.

In one embodiment, the pattern diversity assisted antenna structure is a two arm structure that includes two modes: monopole mode and parasitic mode. The monopole arm is the antenna main radiation element. A symmetrical ground arm provides RF current return path back to the ground plane and provides low band resonance. The RF switch provides an RF open or short circuit to modulate the current flow. The RF feed provides RF excitation to the antenna structure.

Figure 14A:
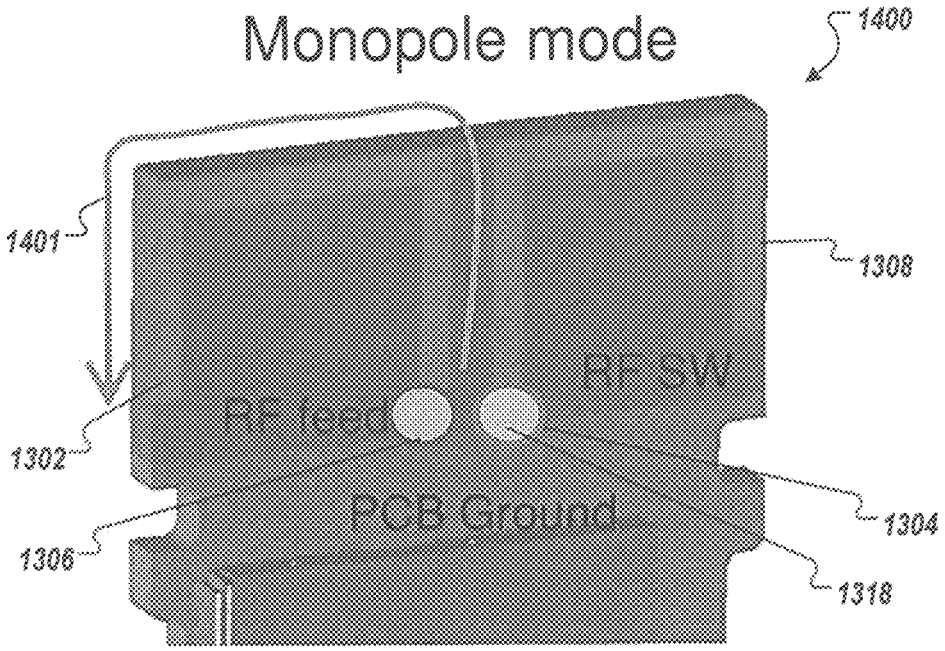
FIG. 14A illustrates a first current flow of the pattern diversity assisted antenna structure of FIG. 13 in a first mode according to one embodiment.

FIG. 14A illustrates a first current flow of the pattern diversity assisted antenna structure 1300 of FIG. 13 in a first mode 1400 according to one embodiment. During operation, the RF circuit 440 (not illustrated in FIG. 14A) causes a first current flow 1401 on the antenna element 702 to generate a first radiation pattern of electromagnetic energy in a first resonant mode 1400 when the RF switch 1304 is in an open state where the parasitic ground element 1308 is not conductively coupled to the grounding point 1318. When in the first mode 1400, the RF switch 1304 is open. Thus, the first current flow 1301 flows from the single RF feed 1306 through the antenna element 1302. No current flow passes to the grounding point 1318 through the open RF switch 1304. The first current flow 1401 results in the pattern diversity assisted antenna structure 1300 operating as a monopole antenna to create the first radiation pattern.

Figure 14B:
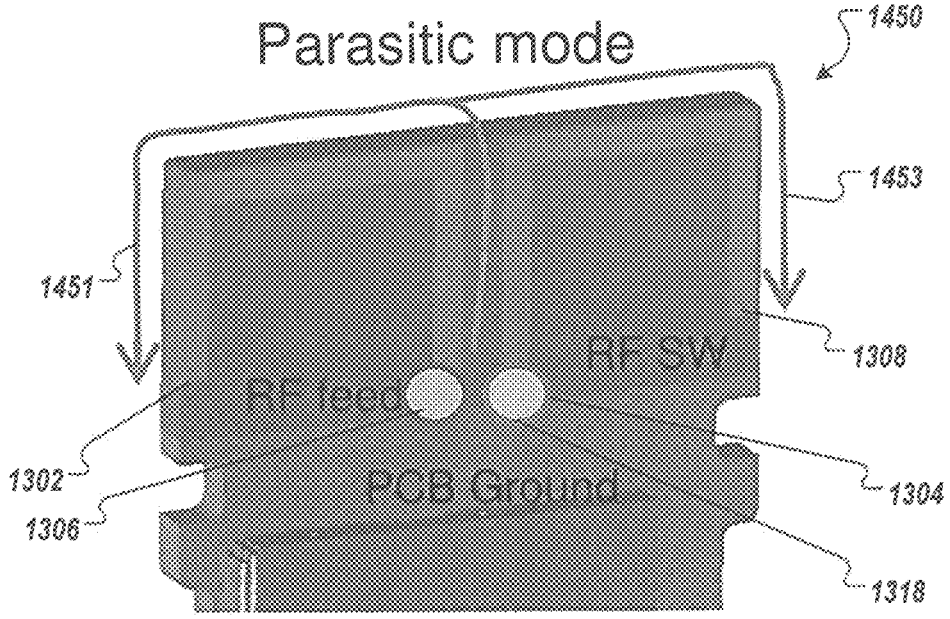
FIG. 14B illustrates a second current flow of the pattern diversity assisted antenna structure of FIG. 13 in a second mode according to one embodiment.

FIG. 14B illustrates a second current flow of the pattern diversity assisted antenna structure 1300 of FIG. 13 in a second mode 1450 according to one embodiment. During operation, the RF circuit 440 (not illustrated in FIG. 14B) causes a first current flow 1451 on the antenna element 1302. A second current flow 1453 is parasitically induced on the second parasitic ground element 1308. The first current flow 1451 and the second current flow 1453 generate a second radiation pattern of electromagnetic energy in a second resonant mode 1450 when the RF switch 1304 is in a closed state where the parasitic ground element 1308 is conductively coupled to the grounding point 1318. When in the second mode 1450, the RF switch 1304 is shorted. Thus, the first current flow 1451 flows from the single RF feed 1306 through the antenna element 1302 and the second current flow 1453 flows from the grounding point 1318 through the shorted RF switch 1304 to the parasitic ground element 1308. The first current flow 1451 and second current flow 1453 results in the pattern diversity assisted antenna structure 1300 operating as a parasitic mode antenna to create the second radiation pattern.

Figure 15:
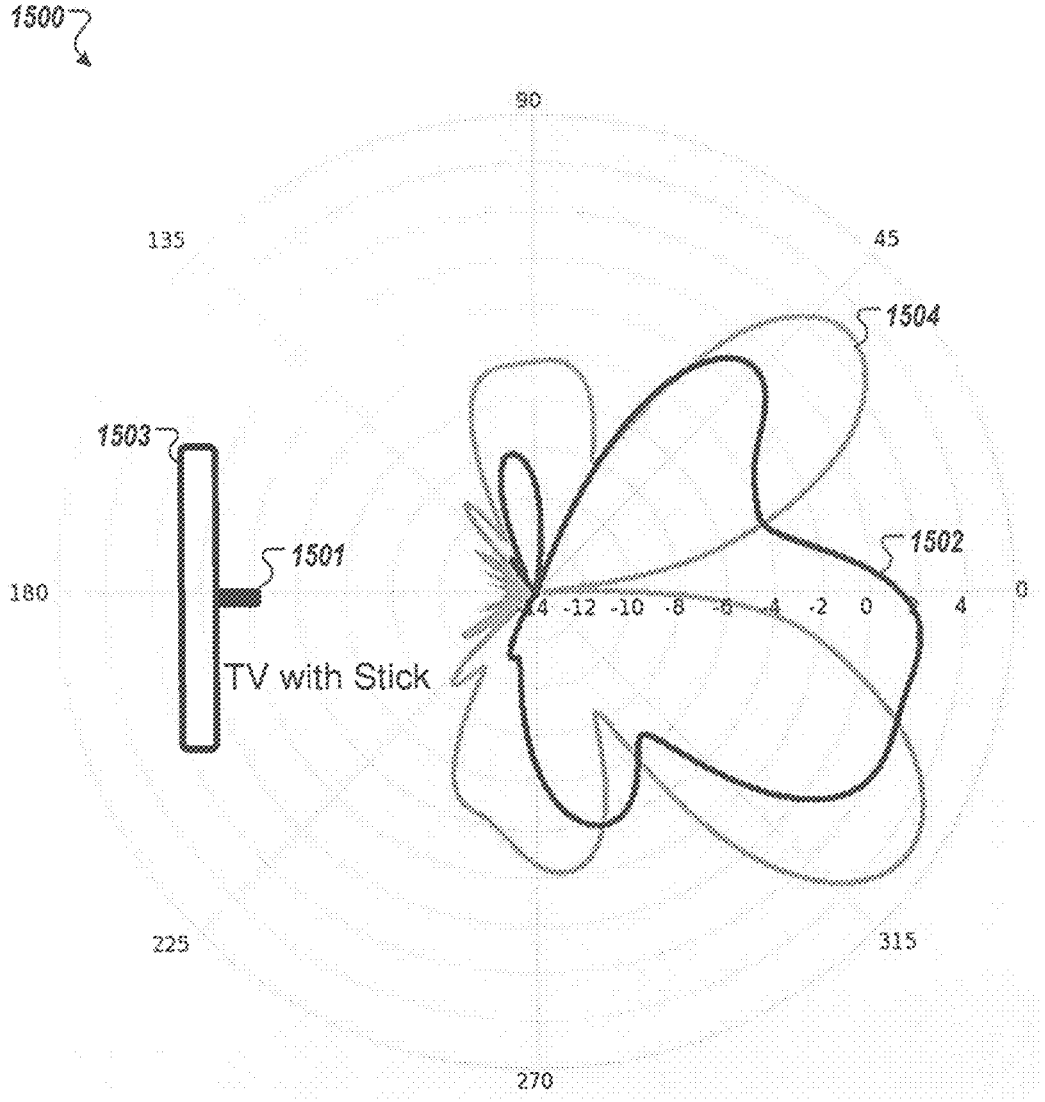
FIG. 15 is a graph of radiation patterns of the pattern diversity assisted antenna structure of FIG. 13 according to one embodiment.

FIG. 15 is a graph of radiation patterns of the pattern diversity assisted antenna structure 1300 of FIG. 13 according to one embodiment. A TV dongle 1501, including the pattern diversity assisted antenna structure 1300 of FIG. 13, is plugged into a TV 1503. When in the first mode 1400, the pattern diversity assisted antenna structure 1300 operates as a monopole antenna and generates a first radiation pattern 1502. When in the second mode 1450, the pattern diversity assisted antenna structure 1300 operates as a parasitic mode antenna and generates a second radiation pattern 1504. The first radiation pattern 1502 is different than the second radiation pattern 1504.

In some embodiments, the antenna mode impedance is very different in the first and second modes. The two modes can be matched to desired working bands of interest (e.g., 2.4 GHz). In one embodiment, the first mode is matched using a first impedance matching circuit and the second modes is matched using a second impedance matching circuit. In another embodiment, a single impedance matching circuit can be used to match both the first mode and the second mode. The impedance matching circuits operate to match an impedance of a respective antenna to an impedance of a RF circuit coupled to the respective antenna to radiate or receive electromagnetic energy in a specified frequency range.

Figure 16:
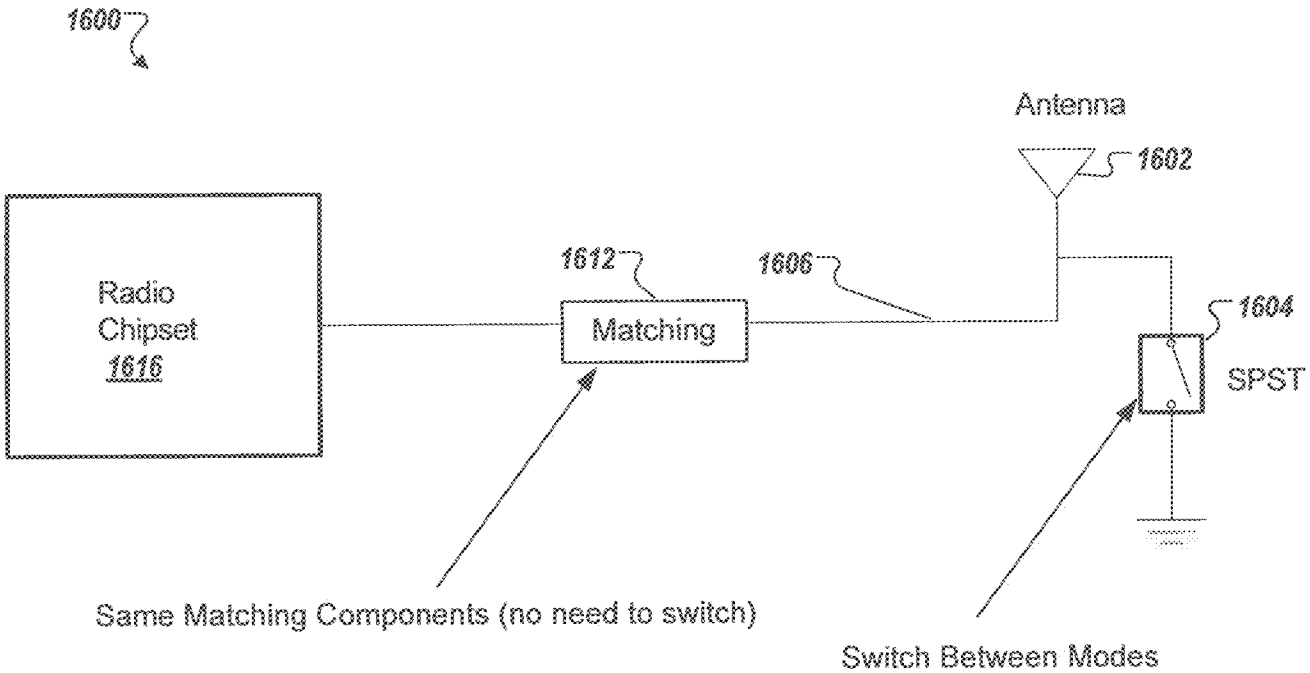
FIG. 16 is a block diagram illustrating a single path of matching components for a pattern diversity assisted antenna structure according to one embodiment.

FIG. 16 is a block diagram 1600 illustrating a single path of matching components for a pattern diversity assisted antenna structure according to one embodiment. In this embodiment, the pattern diversity assisted antenna structure 1602 is coupled to ground via a switch 1604 and is coupled to a RF feed 1606. Between the RF feed 1606 and a radio 1616 (also referred to as radio chipset), a single path of matching components 1612 may be used to match an impedance of the pattern diversity assisted antenna structure 1602 in the different modes. In this embodiment, the same matching components are used for the different modes and there is no need for switching, as illustrated and described with respect to FIG. 10. In some embodiments, the matching components 1612 are organized as an impedance matching network. An impedance matching network is any combination of components used to match an impedance of the radio to an impedance of the antenna structure 1602 in the respective mode.

Figure 17:
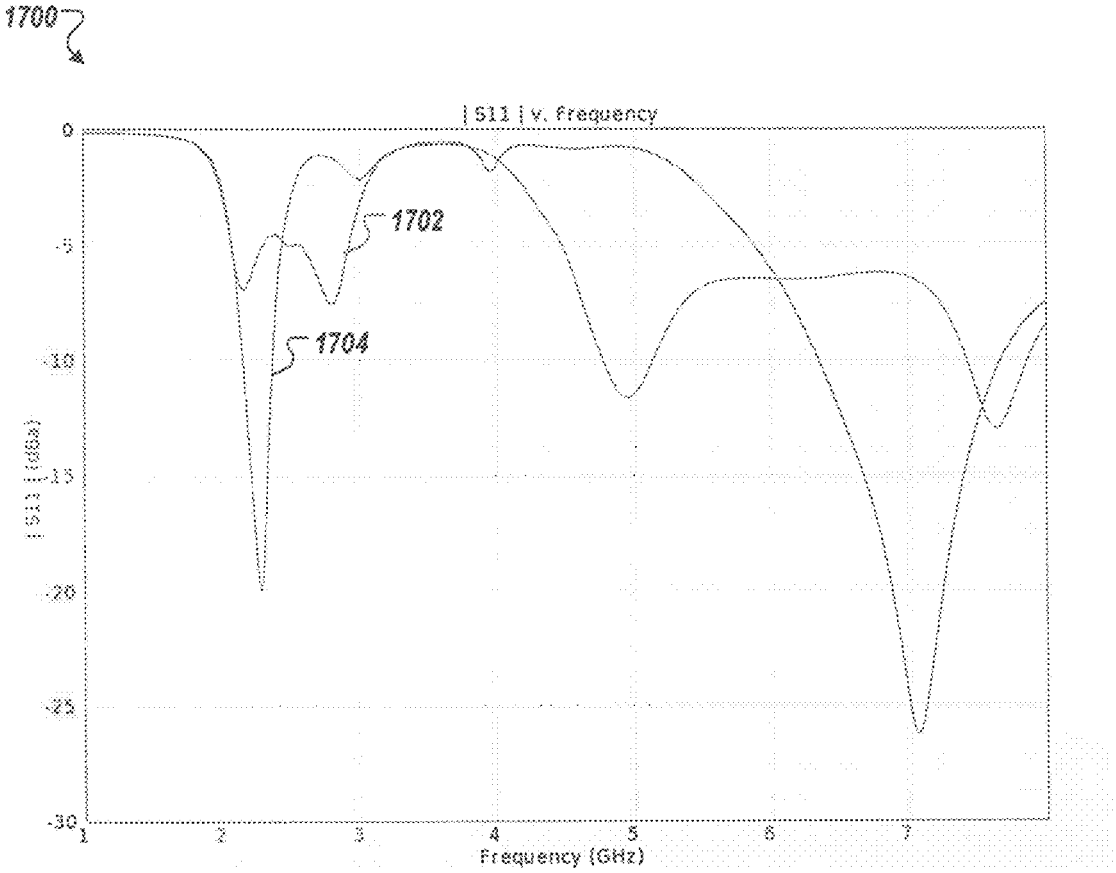
FIG. 17 is a graph of the $S_{11}$ parameter of the pattern diversity assisted antenna structure in FIG. 13 according to one embodiment.

FIG. 17 is a graph 1700 of the $S_{11}$ parameter of the pattern diversity assisted antenna structure 1300 in FIG. 13 according to one embodiment. The graph 1700 shows the $S_{11}$ parameter 1702 of pattern diversity assisted antenna structure 1300 in the first mode (e.g., monopole mode). The graph 1700 also illustrates that pattern diversity assisted antenna structure 1300 in the second mode (e.g., parasitic mode).

As illustrated in FIG. 11A, FIG. 11B, and FIG. 17 the pattern diversity assisted antenna structures 400, 700, 1300 are matched at 2.4 GHz. The pattern diversity assisted antenna structures 400, 700 can be matched with separate matching components. Since the radiation patterns are different for the resonant modes, the pattern diversity assisted antenna structure can achieve low ECC. The pattern diversity assisted antenna structures 400, 700 can have the following ECC values:

| | PATTERN DIVERSITY ASSISTED ANTENNA STRUCTURE 400 (MONOPOLE/ LOOP) | PATTERN DIVERSITY ASSISTED ANTENNA STRUCTURE 700 (MONOPOLE/ COUPLED) | PATTERN DIVERSITY ASSISTED ANTENNA STRUCTURE 1300 (MONOPOLE/ PARASITIC) |
|---|---|---|---|
| ECC | 0.002 | 0.4 | 0.5 |

Figure 18:
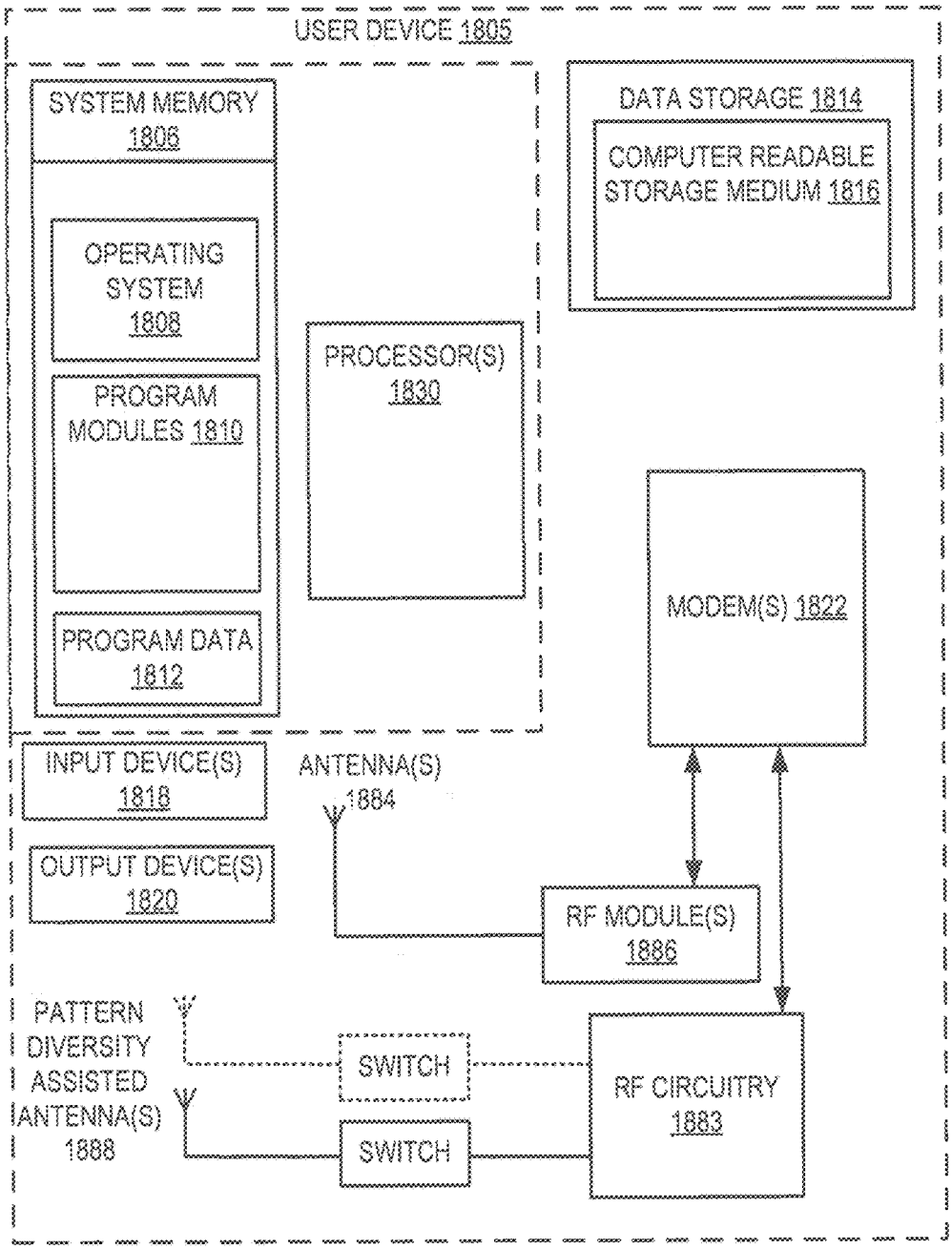
FIG. 18 is a block diagram of a user device in which embodiments of pattern diversity assisted antennas may be implemented.

FIG. 18 is a block diagram of a user device 1805 in which embodiments of pattern diversity assisted antennas may be implemented. The user device 1805 may correspond to the user device 100 of FIG. or the user device 200 of FIG. 2. The user device 1805 may be any type of computing device such as an electronic book reader, a PDA, a mobile phone, a laptop computer, a portable media player, a tablet computer, a camera, a video camera, a netbook, a desktop computer, a gaming console, a DVD player, a computing pad, a media center, and the like. The user device 1805 may be any portable or stationary user device. For example, the user device 1805 may be an intelligent voice control and speaker system. Alternatively, the user device 1805 can be any other device used in a WLAN network (e.g., Wi-Fi® network), a WAN network, or the like.

The user device 1805 includes one or more processor(s) 1830, such as one or more CPUs, microcontrollers, field programmable gate arrays, or other types of processors. The user device 1805 also includes system memory 1806, which may correspond to any combination of volatile and/or non-volatile storage mechanisms. The system memory 1806 stores information that provides operating system component 1808, various program modules 1810, program data 1812, and/or other components. In one embodiment, the system memory 1806 stores instructions of methods to control operation of the user device 1805. The user device 1805 performs functions by using the processor(s) 1830 to execute instructions provided by the system memory 1806.

The user device 1805 also includes a data storage device 1814 that may be composed of one or more types of removable storage and/or one or more types of non-removable storage. The data storage device 1814 includes a computer-readable storage medium 1816 on which is stored one or more sets of instructions embodying any of the methodologies or functions described herein. Instructions for the program modules 1810 may reside, completely or at least partially, within the computer-readable storage medium 1816, system memory 1806 and/or within the processor(s) 1830 during execution thereof by the user device 1805, the system memory 1806 and the processor(s) 1830 also constituting computer-readable media. The user device 1805 may also include one or more input devices 1818 (keyboard, mouse device, specialized selection keys, etc.) and one or more output devices 1820 (displays, printers, audio output mechanisms, etc.).

The user device 1805 further includes a modem 1822 to allow the user device 1805 to communicate via a wireless network (e.g., such as provided by the wireless communication system) with other computing devices, such as remote computers, an item providing system, and so forth. The modem 1822 can be connected to RF circuitry 1883 and zero or more RF modules 1886. The RF circuitry 1883 may be a WLAN module, a WAN module, PAN module, or the like. Antennas 1888 are coupled to the RF circuitry 1883, which is coupled to the modem 1822. Zero or more antennas 1884 can be coupled to one or more RF modules 1886, which are also connected to the modem 1822. The zero or more antennas 1884 may be GPS antennas, NFC antennas, other WAN antennas, WLAN or PAN antennas, or the like. The modem 1822 allows the user device 1805 to handle both voice and non-voice communications (such as communications for text messages, multimedia messages, media downloads, web browsing, etc.) with a wireless communication system. The modem 1822 may provide network connectivity using any type of mobile network technology including, for example, cellular digital packet data (CDPD), general packet radio service (GPRS), EDGE, universal mobile telecommunications system (UMTS), 1 times radio transmission technology (1×RTT), evaluation data optimized (EVDO), high-speed down-link packet access (HSDPA), Wi-Fi®, Long Term Evolution (LTE) and LTE Advanced (sometimes generally referred to as 4G), etc.

The modem 1822 may generate signals and send these signals to pattern diversity antennas 1888, and 1884 via RF circuitry 1883, and RF module(s) 1886 as descried herein. User device 1805 may additionally include a WLAN module, a GPS receiver, a PAN transceiver and/or other RF modules. These RF modules may additionally or alternatively be connected to one or more of antennas 1884, 1888. Antennas 1884, 1888 may be configured to transmit in different frequency bands and/or using different wireless communication protocols. The antennas 1884, 1888 may be directional, omnidirectional, or non-directional antennas. In addition to sending data, antennas 1884, 1888 may also receive data, which is sent to appropriate RF modules connected to the antennas. One of the antennas 1884 may be any combination of the pattern diversity assisted antenna structures 400, 700, 1300 as described herein.

In one embodiment, the user device 1805 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WLAN hotspot and a connection to a wireless carrier system. In one embodiment, the first wireless connection is associated with a first resonant mode of an antenna structure that operates at a first frequency band and the second wireless connection is associated with a second resonant mode of the antenna structure that operates at a second frequency band. In another embodiment, the first wireless connection is associated with a first antenna element and the second wireless connection is associated with a second antenna element. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a modem 1822 is shown to control transmission and reception via antenna (1884, 1888), the user device 1805 may alternatively include multiple modems, each of which is configured to transmit/receive data via a different antenna and/or wireless transmission protocol.

The user device 1805 delivers and/or receives items, upgrades, and/or other information via the network. For example, the user device 1805 may download or receive items from an item providing system. The item providing system receives various requests, instructions and other data from the user device 1805 via the network. The item providing system may include one or more machines (e.g., one or more server computer systems, routers, gateways, etc.) that have processing and storage capabilities to provide the above functionality. Communication between the item providing system and the user device 1805 may be enabled via any communication infrastructure. One example of such an infrastructure includes a combination of a WAN and wireless infrastructure, which allows a user to use the user device 1805 to purchase items and consume items without being tethered to the item providing system via hardwired links. The wireless infrastructure may be provided by one or multiple wireless communications systems, such as one or more wireless communications systems. One of the wireless communication systems may be a WLAN hotspot connected with the network. The WLAN hotspots can be created by Wi-Fi® products based on IEEE 802.11x standards by Wi-Fi Alliance. Another of the wireless communication systems may be a wireless carrier system that can be implemented using various data processing equipment, communication towers, etc. Alternatively, or in addition, the wireless carrier system may rely on satellite technology to exchange information with the user device 1805.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public WAN such as the Internet.

The user devices 1805 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 1805 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. An electronic device comprising:

a ground plane;

a single radio frequency (RF) feed;

RF circuitry coupled to the single RF feed;

an antenna element comprising a first end and a second end, the first end being coupled to the single RF feed;

a parasitic ground element comprising a first end and a second end, wherein at least the second end of the parasitic ground element is located outside an area defined between the antenna element and the ground plane; and a single-pole-single-throw (SPST) switch coupled between the first end of the parasitic ground element and the ground plane, wherein the RF circuitry is operable to control the SPST switch between a closed state and an open state, wherein the RF circuitry is operable to cause a first current flow on the antenna element from the first end at the single RF feed to the second end of the antenna element to generate a first radiation pattern of electromagnetic energy in a first resonant mode when the SPST switch is in the open state, wherein the RF circuit is operable to cause a second current flow on the antenna element from the first end at the single RF feed to the second end of the antenna element and a third current flow on the parasitic ground element from the first end of the parasitic ground element at the SPST switch to the second end of the parasitic ground element to generate a second radiation pattern of electromagnetic energy in a second resonant mode when the SPST switch is in the closed state, wherein the antenna element operates as a monopole antenna when the SPST switch is in the open state, wherein the antenna element and the parasitic ground element together operate as a coupled mode antenna when the SPST switch is in the closed state, wherein the second radiation pattern is different than the first radiation pattern, and wherein a segment of the antenna element extends in a first direction such that a portion of the antenna element is disposed in a first gap between a first segment and a second segment of the parasitic ground element, the second segment extending in a second direction beyond a second end of the antenna element, wherein there is a second gap between a portion of the second segment and a portion of the antenna element.

2. The electronic device of claim 1, wherein the RF circuitry comprises a wireless local area network (WLAN) module, wherein the WLAN module is operable to cause the antenna element to radiate electromagnetic energy in a frequency range in the first resonant mode and cause the antenna element and the parasitic ground element to radiate electromagnetic energy in the same frequency range in the second resonant mode, and wherein the first resonant mode and the second resonant mode are de-correlated modes.

3. The electronic device of claim 1, wherein the antenna element comprises a first arm having a first effective length between the first end coupled to the RF feed and the second end at a distal end of the first arm, wherein the parasitic ground element comprises a second arm having a second effective length between the first end at a proximal end of the second arm and the second end at a distal end of the second arm, the first end of the second arm being coupled to the ground plane at a grounding point, wherein the first arm and the second arm are coplanar, and wherein a segment of the first arm extends in the first direction such that the second end of the first arm is disposed in the first gap between a first segment and a second segment of the second arm, the second segment extending in the second direction beyond the second end of the first arm, wherein the second gap is between the portion of the second segment and the segment of the first arm.

4. An apparatus comprising:

a radio frequency (RF) feed;

a radio coupled to the RF feed;

a RF switch coupled to a ground plane;

a first antenna element comprising a first end and a second end, the first end being coupled to the RF feed; and a second antenna element comprising a first end and a second end, the first end being coupled to the RF switch, wherein at least the second end of the second antenna element is located outside an area defined between the first antenna element and the ground plane, wherein the radio is operable to cause the first antenna element to radiate electromagnetic energy in a first radiation pattern in a first mode, wherein the radio is operable to cause the first antenna element and the second antenna element to radiate electromagnetic energy in a second radiation pattern in a second mode, wherein a segment of the first antenna element extends in a first direction such that a portion of the first antenna element is disposed in an area between a first segment and a second segment of the second antenna element, the second segment extending in a second direction beyond a second end of the first antenna element.

5. The apparatus of claim 4, wherein the second mode is de-correlated from the first mode.

6. The apparatus of claim 5, wherein the first antenna element and the second antenna element are co-located on an antenna carrier, and wherein an envelope correlation coefficient between the first radiation pattern and the second radiation pattern is between approximately 0.4 to approximately 0.5.

7. The apparatus of claim 4, wherein the RF feed is a single RF feed, wherein:

in the first mode, the radio is operable to apply a RF signal to the single RF feed that causes a first current flow on the first antenna element from the first end of the first antenna element to the second end of the first antenna element to radiate the electromagnetic energy in the first radiation pattern, and in the second mode, the radio is operable to apply the RF signal to the single RF feed that causes a redirection of the first current flow to generate a second current flow on the first antenna element from the first end of the first antenna element to the second end of the first antenna element and a third current flow on the second antenna element from the first end of the second antenna element to the second end of the second antenna element to radiate the electromagnetic energy in the second radiation pattern.

8. The apparatus of claim 4, wherein the first antenna element is self-resonant at approximately 2.4 GHz when the RF switch is in an open state, and wherein the first antenna element and the second antenna element are self-resonant at approximately 2.4 GHz when the RF switch is in a closed state.

9. The apparatus of claim 4, wherein the radio comprises a wireless local area network (WLAN) radio, wherein the WLAN radio is operable to cause the first antenna element to radiate electromagnetic energy in a frequency range in the first mode and to cause the first antenna element and the second antenna element to radiate electromagnetic energy in the frequency range in the second mode.

10. The apparatus of claim 4, wherein the first antenna element operates as a monopole antenna in the first mode, and wherein the first antenna element and the second antenna element together operate as a coupled mode antenna in the second mode.

11. The apparatus of claim 4, wherein the first antenna element operates as a monopole antenna in the first mode, and wherein the first antenna element and the second antenna element together operate as a parasitic mode antenna in the second mode.

12. The apparatus of claim 4, further comprising:

a first single-pole-double-throw (SPDT) switch coupled to the radio;

a second SPDT RF switch;

a first impedance matching network coupled between the first SPDT switch and the second SPDT switch in a first path; and a second impedance matching network coupled between the first SPDT switch and the second SPDT switch in a second path.

13. An apparatus comprising:

a radio frequency (RF) feed;

a radio coupled to the RF feed;

a RF switch coupled to a ground plane;

a first antenna element coupled to the RF feed; and a second antenna element coupled to the RF switch, wherein the radio is operable to control the RF switch between a first mode and a second mode, wherein the radio is operable to cause the first antenna element to radiate electromagnetic energy in a first radiation pattern in the first mode, wherein the radio is operable to cause the second antenna element to radiate electromagnetic energy in a second radiation pattern in the second mode, and wherein the second radiation pattern is different than the first radiation pattern, wherein:

the first antenna element comprises a first arm having a first effective length between a first end coupled to the RF feed and a second end at a distal end of the first arm;

the second antenna element comprises a second arm having a second effective length between the first end at a proximal end of the second arm and the second end at a distal end of the second arm, the first end of the second arm being coupled to the ground plane at a grounding point;

the first arm and the second arm are coplanar; and a segment of the first arm extends in a first direction such that the second end of the first arm is disposed in a first gap between a first segment and a second segment of the second arm, the second segment extending in a second direction beyond the second end of the first arm, wherein a second gap is between a portion of the second segment and the segment of the first arm.

14. A device comprising:

a housing;

a connector that extends out from the housing for insertion into a plug-in port of another electronic device;

a printed circuit board (PCB) disposed within the housing and coupled to the connector, wherein the PCB comprises a ground plane;

a radio frequency (RF) circuit disposed on the PCB;

an antenna carrier disposed within the housing, the antenna carrier being coplanar with the ground plane of the PCB;

an antenna element disposed on the antenna carrier, the antenna element comprising a first end and a second end, the first end being coupled to the RF circuit via an RF feed;

a parasitic ground element disposed on the antenna carrier, the parasitic ground element comprising a first end and a second end, wherein at least the second end of the parasitic ground element is located outside an area defined between the antenna element and the ground plane; and a RF switch coupled to the first end of the parasitic ground element and a grounding point on the ground plane, wherein the RF circuit is operable to cause a first current flow on the antenna element to generate a first radiation pattern of electromagnetic energy in a first resonant mode when the RF switch is in an open state where the parasitic ground element is not conductively coupled to the grounding point, and wherein the RF circuit is operable to cause a second current flow on the antenna element and a third current flow on the parasitic ground element to generate a second radiation pattern of electromagnetic energy in a second resonant mode when the RF switch is in a closed state where the parasitic ground element is conductively coupled to the grounding point, wherein a segment of the antenna element extends in a first direction such that a portion of the antenna element is disposed in a first gap between a first segment and a second segment of the parasitic ground element, the second segment extending in a second direction beyond an end of the antenna element, wherein a second gap is between a portion of the second segment and a portion of the antenna element.

15. The device of claim 14, wherein the antenna element comprises a first arm having a first effective length between the first end coupled to the RF feed and the second end at a distal end of the first arm, wherein the parasitic ground element comprises a second arm having a second effective length between the first end at a proximal end of the second arm and the second end at a distal end of the second arm, the first end of the second arm being coupled to the ground plane at the grounding point, wherein the first arm and the second arm are coplanar, and wherein a segment of the first arm extends in a first direction such that the second end of the first arm is disposed in a first gap between a first segment and a second segment of the second arm, the second segment extending in a second direction beyond the second end of the first arm, wherein a second gap is between a portion of the second segment and the segment of the first arm.

16. The device of claim 14, further comprising:

a first single-pole-double-throw (SPDT) switch coupled to the RF circuit;

a second SPDT RF switch;

a first impedance matching network coupled between the first SPDT switch and the second SPDT switch in a first path; and a second impedance matching network coupled between the first SPDT switch and the second SPDT switch in a second path, wherein the RF circuit is operable to control the first SPDT switch and the second SPDT switch to direct current through the first path in the first mode and through the second path in the second mode, wherein an impedance of the first impedance matching network is different than the impedance of the second impedance matching network.

* * * * *